US007320412B2

(12) United States Patent
Fitzgerald

(10) Patent No.: US 7,320,412 B2
(45) Date of Patent: Jan. 22, 2008

(54) DISPENSING SYSTEMS AND METHODS

(75) Inventor: Robert M. Fitzgerald, Norcross, GA (US)

(73) Assignee: Innovative Product Achievements, Inc., Duluth, GA (US)

( * ) Notice: Subject to any disclaimer, the term of this patent is extended or adjusted under 35 U.S.C. 154(b) by 460 days.

(21) Appl. No.: 10/851,859

(22) Filed: May 20, 2004

(65) Prior Publication Data

US 2005/0258184 A1 Nov. 24, 2005

(51) Int. Cl.
*G07F 11/00* (2006.01)

(52) U.S. Cl. ..... 221/25; 221/75; 221/86; 221/154

(58) Field of Classification Search ..... 221/25, 221/75, 154, 76, 82, 86
See application file for complete search history.

(56) References Cited

U.S. PATENT DOCUMENTS 737,665 A * 9/1903 Rupley ..... 221/86
2,115,393 A * 4/1938 Mahaffey ..... 221/77
2,254,737 A * 9/1941 Fry ..... 221/86
3,194,432 A * 7/1965 Breitenstein et al. ..... 221/82
3,941,279 A * 3/1976 Krakauer ..... 221/86
4,671,426 A * 6/1987 Grossi ..... 221/75

* cited by examiner

*Primary Examiner*—David H Bollinger
(74) *Attorney, Agent, or Firm*—Alston & Bird LLP

(57) ABSTRACT

A dispenser comprising a first barrier, and a second barrier that is spaced apart from the first barrier. These two barriers define a first item-receiving space between the barriers, and the second barrier at least partially defines a second item-receiving space behind the second barrier. The first barrier is adapted to move between: (A) a first-barrier-closed position in which the first barrier restricts access to the first item-receiving space, and (B) a first-barrier-open position in which the first barrier permits access to the first item-receiving space. Similarly, the second barrier is adapted to move between: (A) a second-barrier-closed position in which the second barrier restricts access to the second item-receiving space, and (B) a second-barrier-open position in which the second barrier permits access to the second item-receiving space. The dispenser may comprise a third barrier, and the first, second, and third barriers may be positioned in a substantially horizontal array.

84 Claims, 13 Drawing Sheets

DISPENSING SYSTEMS AND METHODS

BACKGROUND OF THE INVENTION

Current dispensing systems are used to dispense various items such as soft drinks and food items. Dispensing systems are also used to dispense items, such as surgical scrubs, in a hospital setting. However, there still exists a need for improved dispensers that, for example, are inexpensive to build, that take up less space than current dispensers, and that dispense items to users in a more convenient manner than prior art dispensers.

SUMMARY OF THE INVENTION

A dispenser according to one embodiment of the invention comprises a first barrier disposed within the dispenser, and a second barrier that is disposed within the dispenser and that is spaced apart from the first barrier. In one embodiment of the invention, the first and second barriers at least partially define a first item-receiving space between the first and second barriers, and the second barrier at least partially defines a second item-receiving space behind the second barrier. In a particular embodiment, the first barrier is adapted to move between: (A) a first-barrier-closed position in which the first barrier substantially restricts access to the first item-receiving space, and (B) a first-barrier-open position in which the first barrier is positioned to permit access to the first item-receiving space. In addition, the second barrier is adapted to move between: (A) a second-barrier-closed position in which the second barrier substantially restricts access to the second item-receiving space, and (B) a second-barrier-open position in which the second barrier is positioned to permit access to the second item-receiving space.

In a particular embodiment of the invention, the dispenser comprises a third barrier; and the first, second, and third barriers are positioned in a substantially horizontal array. In a further embodiment of the invention, at least one of the first, second, and third barriers is mounted to pivot between an open and a closed position. Also, in one embodiment, at least one of the first, second, and third barriers is mounted to at least partially retract into a recess after being pivoted into an open position.

In a further embodiment of the invention, the dispenser comprises a first barrier locking member for selectively locking the first barrier in the first-barrier-closed position, and the first barrier locking member is positioned adjacent a free end of the first barrier to selectively restrict the movement of the first barrier into the first-barrier-open position. In one embodiment of the invention, the first barrier locking member is adapted to rotate between a first-barrier-locked position in which the first barrier locking member restricts the movement of the first barrier into the first-barrier-open position, and a first-barrier-unlocked position in which the first barrier locking member does not substantially restrict the movement of the first barrier into the first-barrier-open position. The dispenser may include similar barrier locking members for selectively locking the second and third barriers in the barrier-closed position.

In one embodiment of the invention, the dispenser further comprises a locking member actuation device that is configured to selectively prevent the first barrier locking member from rotating from the first-barrier-locked position to the first-barrier-unlocked position. In a further embodiment of the invention, the dispenser further comprises an actuation device control member that is configured to selectively move the locking member actuation device from the first position into the second position.

A dispenser according to another embodiment of the invention comprises: (1) an item housing; and (2) a barrier disposed adjacent the item housing, the barrier being adapted to selectively restrict access to one or more items within the item housing. In a particular embodiment of the invention, the barrier is adapted to rotate between a closed position in which the barrier restricts access to the one or more items within the item housing and an open position in which the barrier does not substantially restrict access to the one or more items. In one embodiment, the barrier is adapted to slide from the closed position to a storage position.

A method of dispensing items according to one embodiment of the invention comprises: (1) providing a horizontal array of barriers comprising a first barrier, a second barrier, and a third barrier; (2) positioning a first item between the first and second barriers; (3) positioning a second item between the second and third barriers; (4) dispensing the first item by rotating the first barrier from a first-barrier closed position in which the first barrier restricts access to the first item, to a first-barrier open position, in which the first barrier does not substantially restrict access to the first item; and (5) dispensing the second item by rotating the second barrier from a second-barrier closed position in which the second barrier restricts access to the second item, to a second-barrier open position, in which the second barrier does not substantially restrict access to the second item.

A dispenser according to another embodiment of the invention comprises: (1) a first barrier/lock assembly that is adapted to be moved between a first first-barrier/lock-assembly orientation in which the first barrier/lock assembly does not permit access to a first item adjacent the first barrier/lock assembly, and a second first-barrier/lock-assembly orientation in which the first barrier/lock assembly permits access to the first item; (2) a second barrier/lock assembly that is adapted to be moved between a first second-barrier/lock-assembly orientation in which the second barrier/lock assembly does not permit access to a second item adjacent the second barrier/lock assembly, and a second second-barrier/lock-assembly orientation in which the second barrier/lock assembly permits access to the second item; and (3) a rotatable member that is adapted so that: (A) when the rotatable member is rotated in a first direction to a first extent, the rotatable member moves the first barrier/lock assembly from the first first-barrier/lock-assembly orientation to the second first-barrier/lock-assembly orientation; and (B) when the rotatable member is rotated in the first direction to a second extent, the rotatable member moves the second barrier/lock assembly from the first second-barrier/lock-assembly orientation to the second second-barrier/lock-assembly orientation.

In a further embodiment, the dispenser further comprises a third barrier/lock assembly that is adapted to be moved between a first third-barrier/lock-assembly orientation in which the third barrier/lock assembly does not permits access to a third item adjacent the third barrier/lock assembly, and a second third-barrier/lock-assembly orientation in which the third barrier/lock assembly permits access to the third item. In one embodiment, this rotatable member is adapted so that when the rotatable member is rotated in the first direction to a third extent, the rotatable member moves the third barrier/lock assembly from the first third-barrier/lock-assembly orientation to the second third-barrier/lock-assembly orientation. In a particular embodiment of the invention, the first, second, and third barrier/lock assemblies are positioned in an array.

In one embodiment of the invention, the rotatable member is adapted for, in response to the rotatable member being rotated in the first direction, configuring the dispenser to allow a user to sequentially load the first, second, and third items into the dispenser.

BRIEF DESCRIPTION OF THE DRAWINGS

Figure 1:
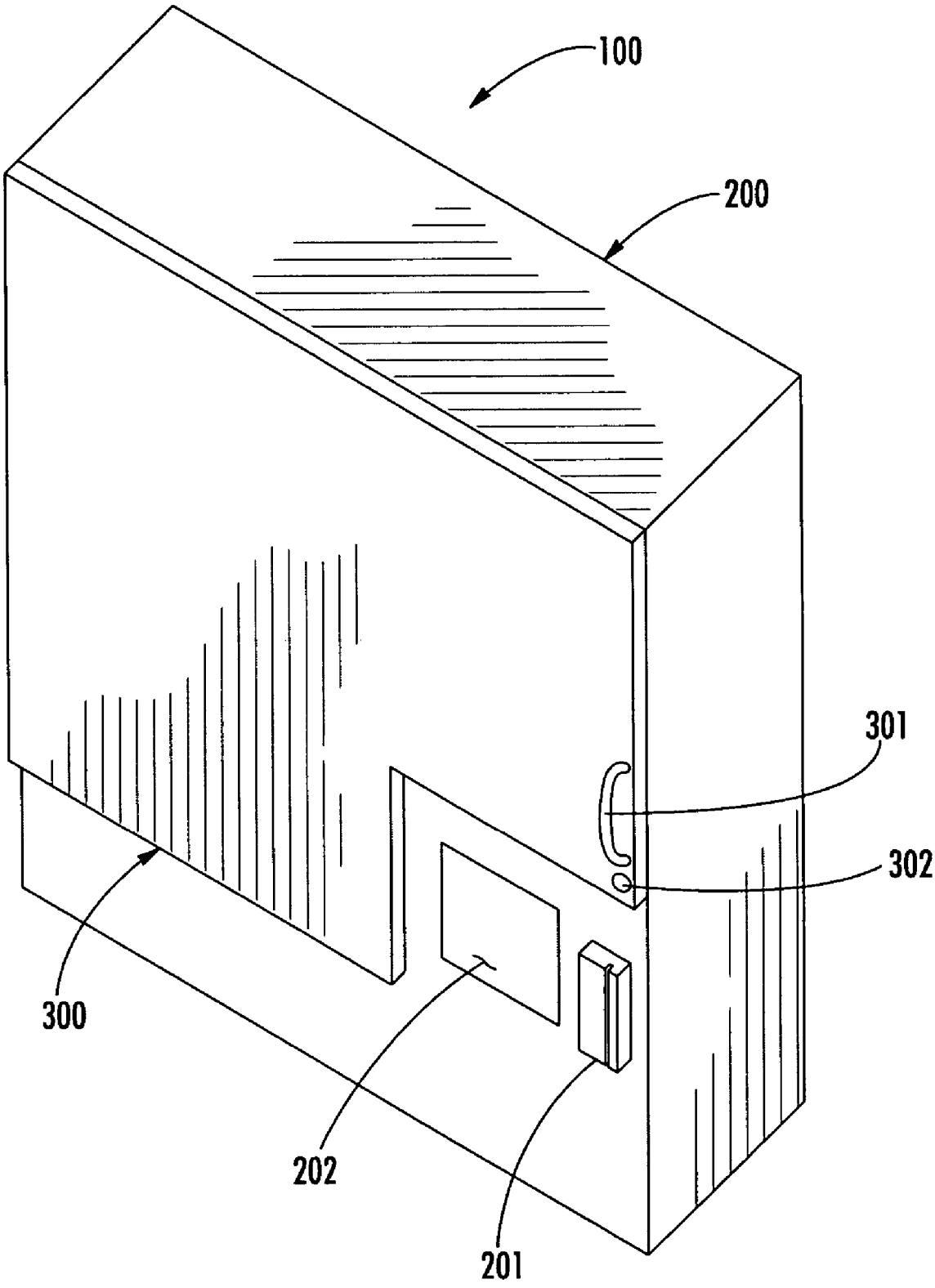

Having thus described the invention in general terms, reference will now be made to the accompanying drawings, which are not necessarily drawn to scale, and wherein:

FIG. 1 is a perspective view of a dispenser according to one embodiment of the invention with its door in a closed position.

Figure 2:
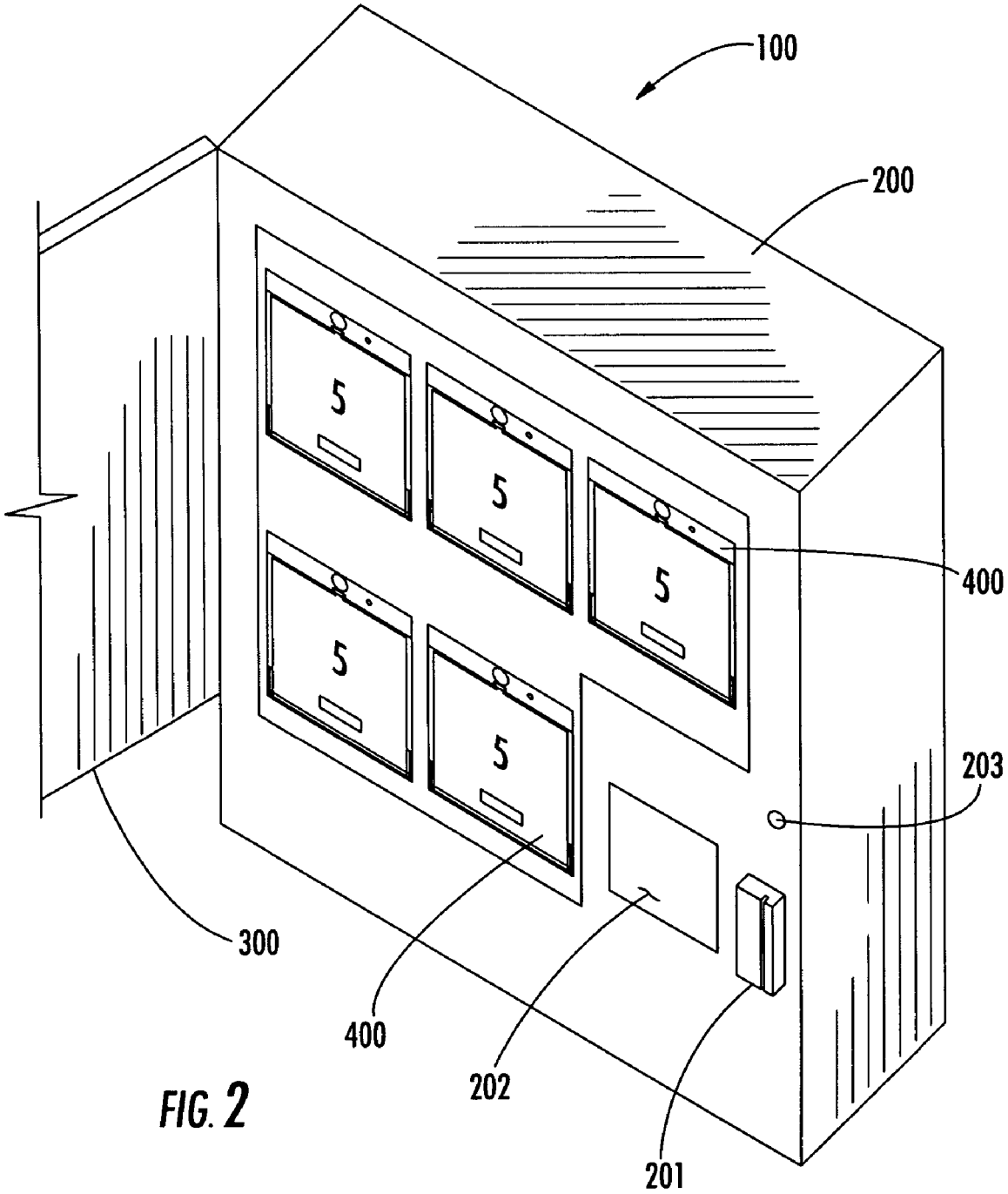

FIG. 2 is a perspective view of the dispenser of FIG. 1 with its door in an open position.

Figure 3:
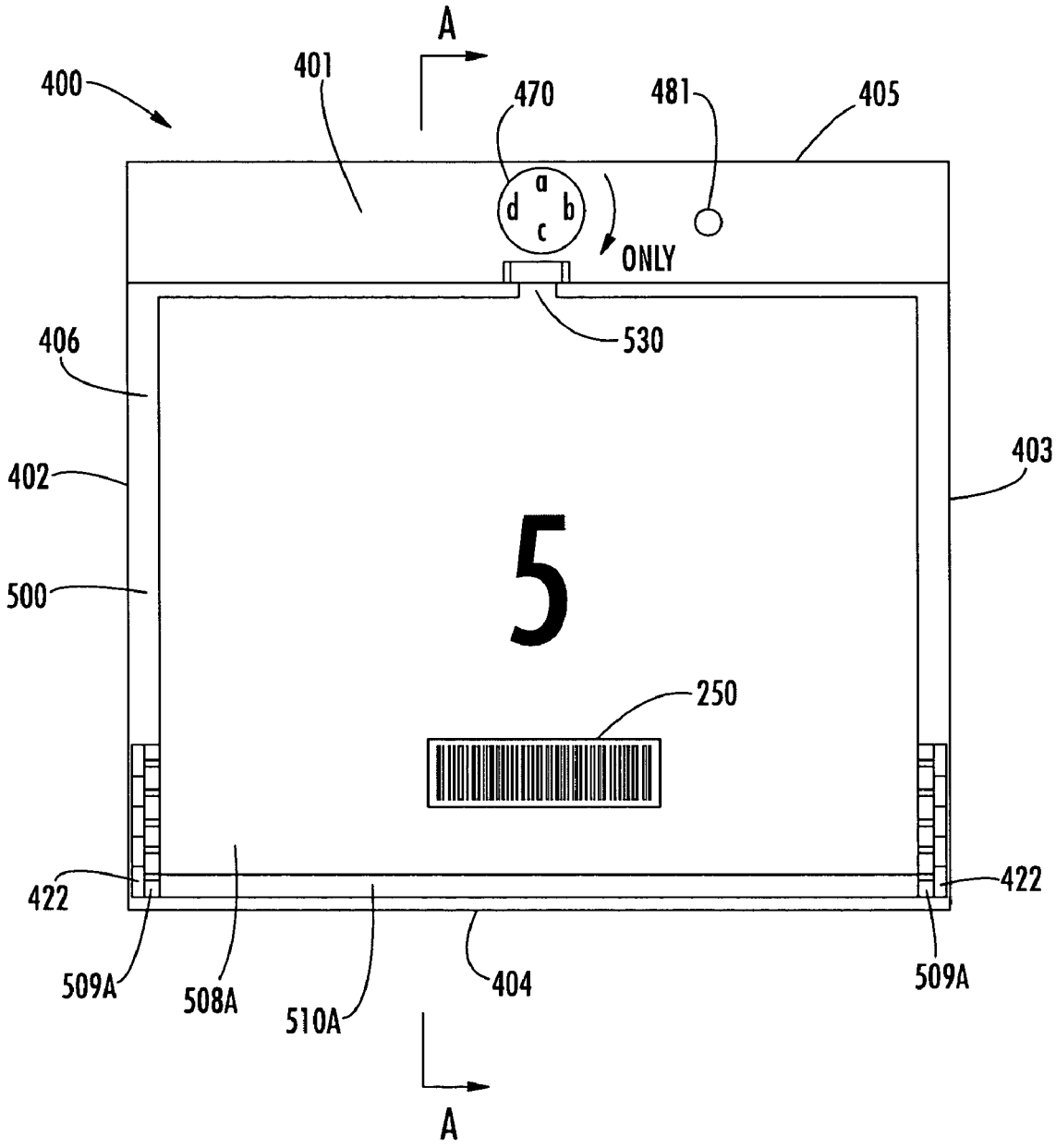

FIG. 3 is a front view of a dispenser module according to one embodiment of the invention.

Figure 4A:
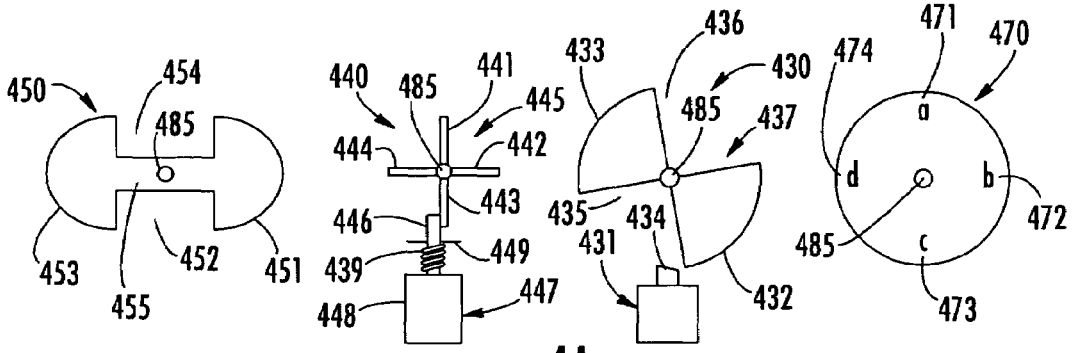
Figure 4:
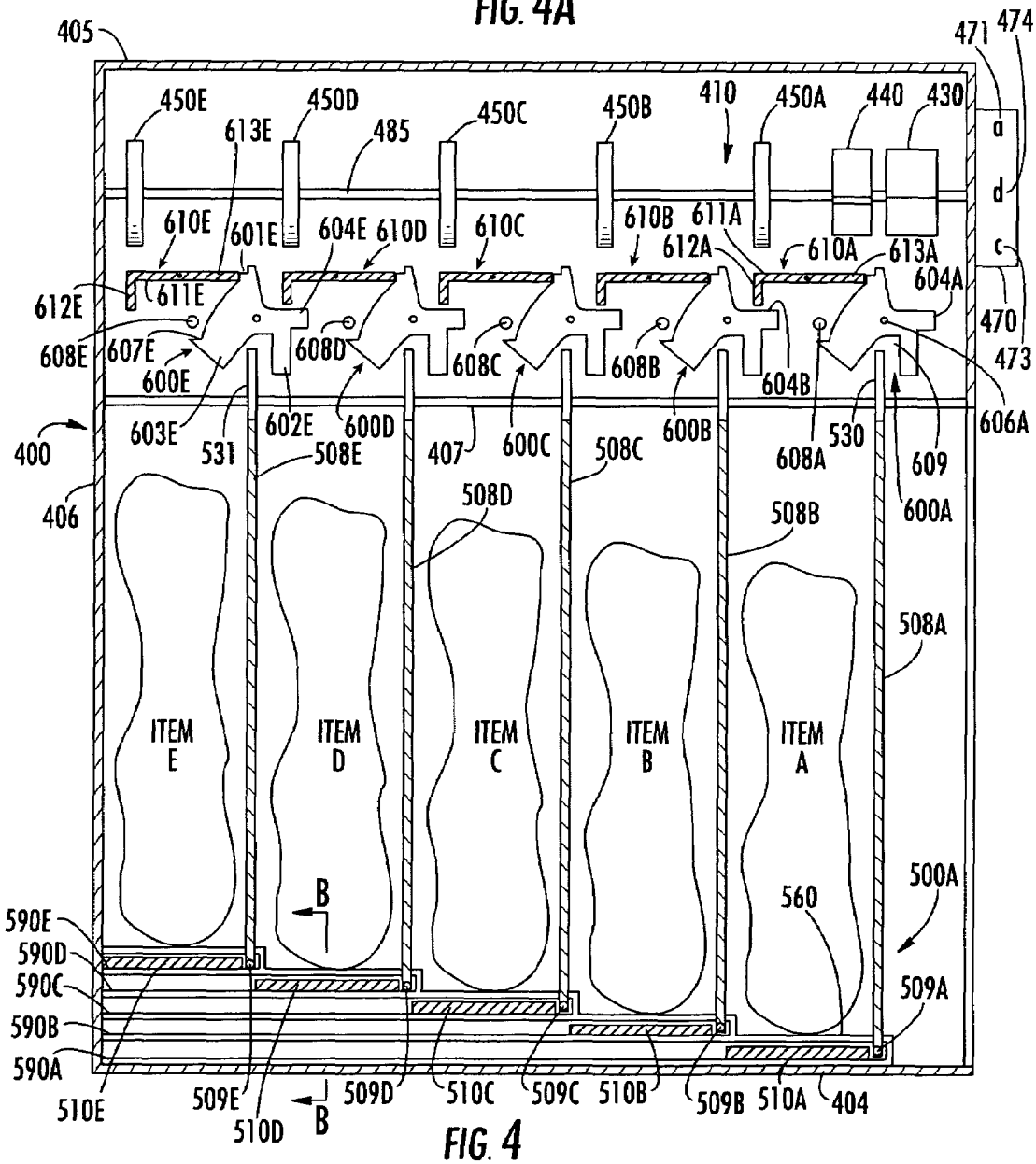

FIG. 4 is a cross-sectional view of the module shown in FIG. 3 taken along line A-A. The dispenser is shown in "load mode" and all of the barriers are in the locked position.

FIG. 4A represents front views of the control knob, position sensor assembly, lock assembly, and actuation device control member shown in FIG. 4.

Figure 4B:
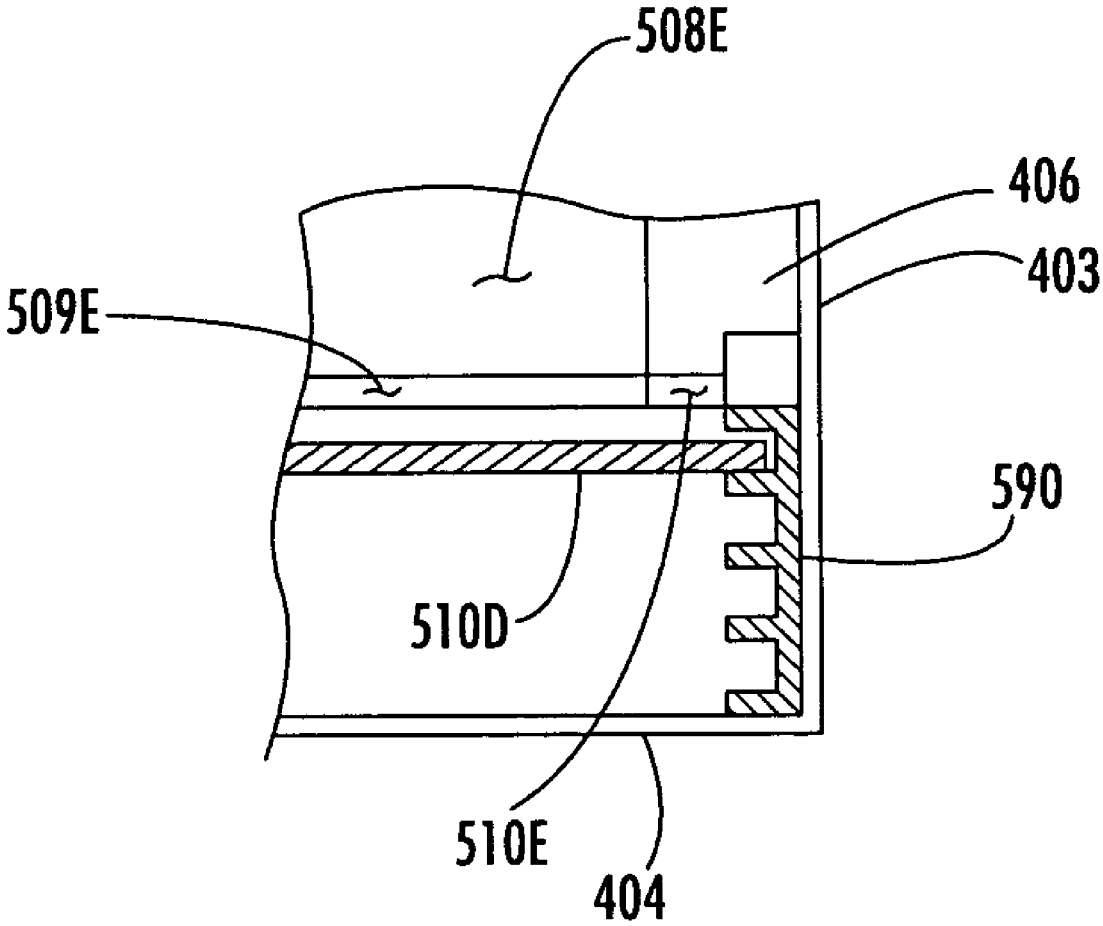

FIG. 4B is a cross sectional view of the module shown in FIG. 4 taken along line B-B. This figure shows a detailed view of the module's various barrier storage compartments.

Figure 5:
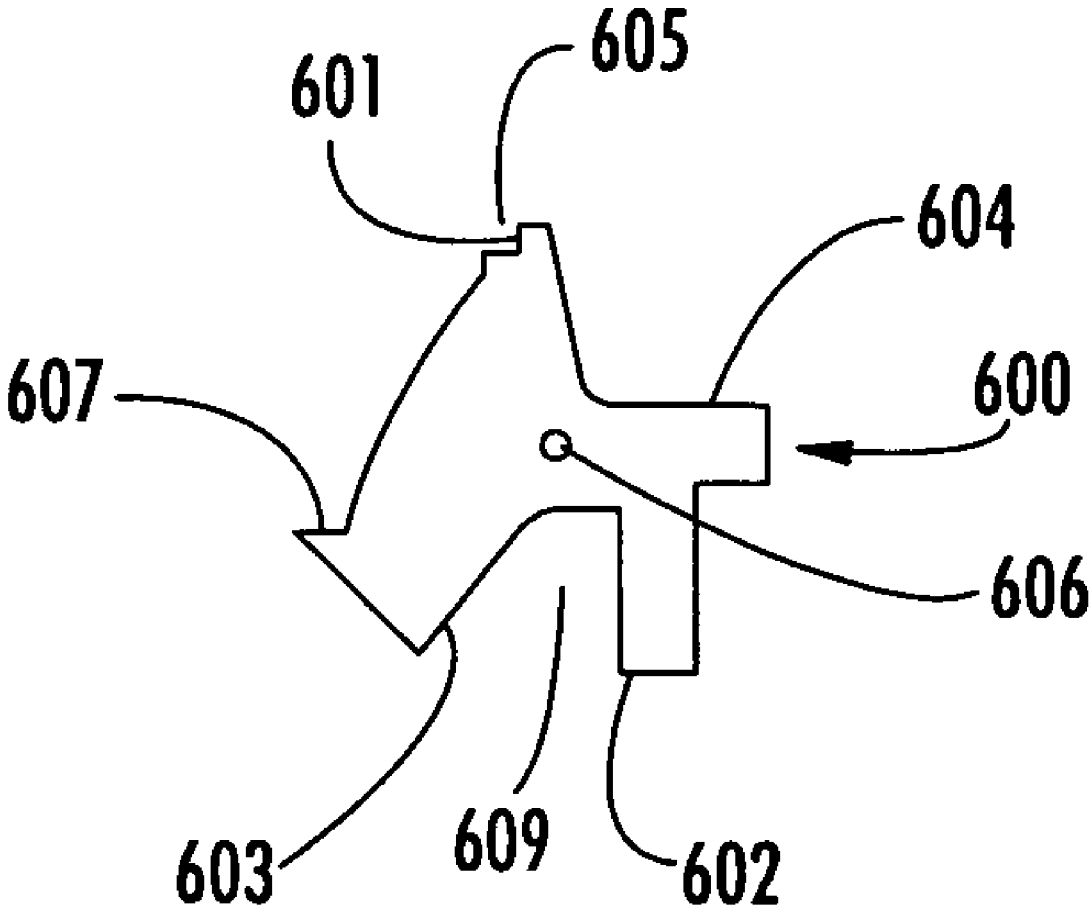

FIG. 5 is a side view of a barrier locking member according to one embodiment of the invention.

Figure 6:
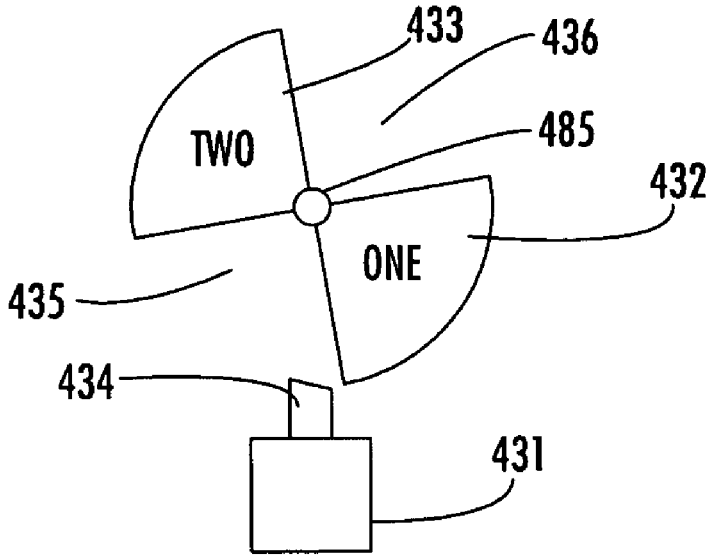

FIG. 6 is a front view of a position sensor assembly according to one embodiment of the invention.

Figure 7:
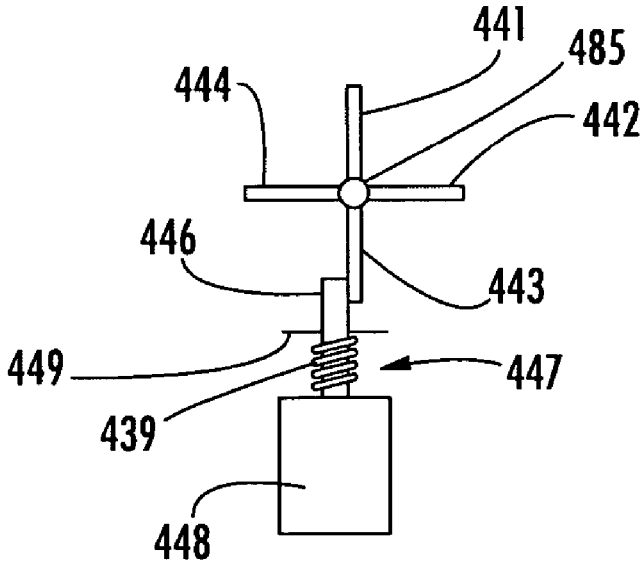

FIG. 7 is a front view of a lock assembly according to one embodiment of the invention.

Figure 8A:
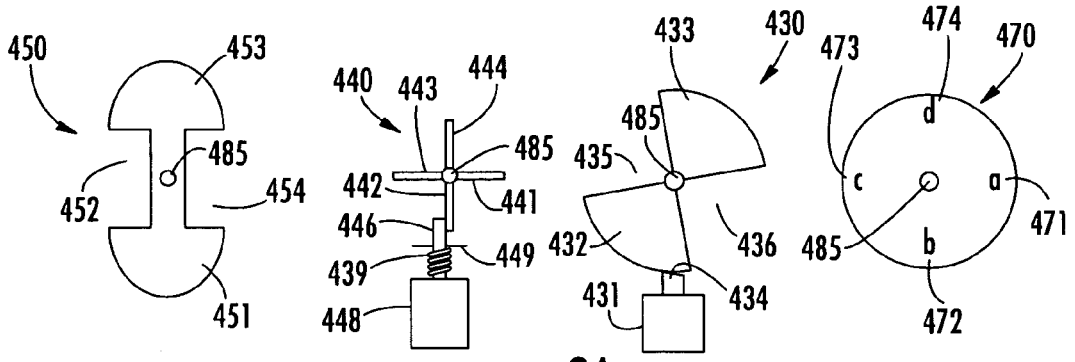
Figure 8:
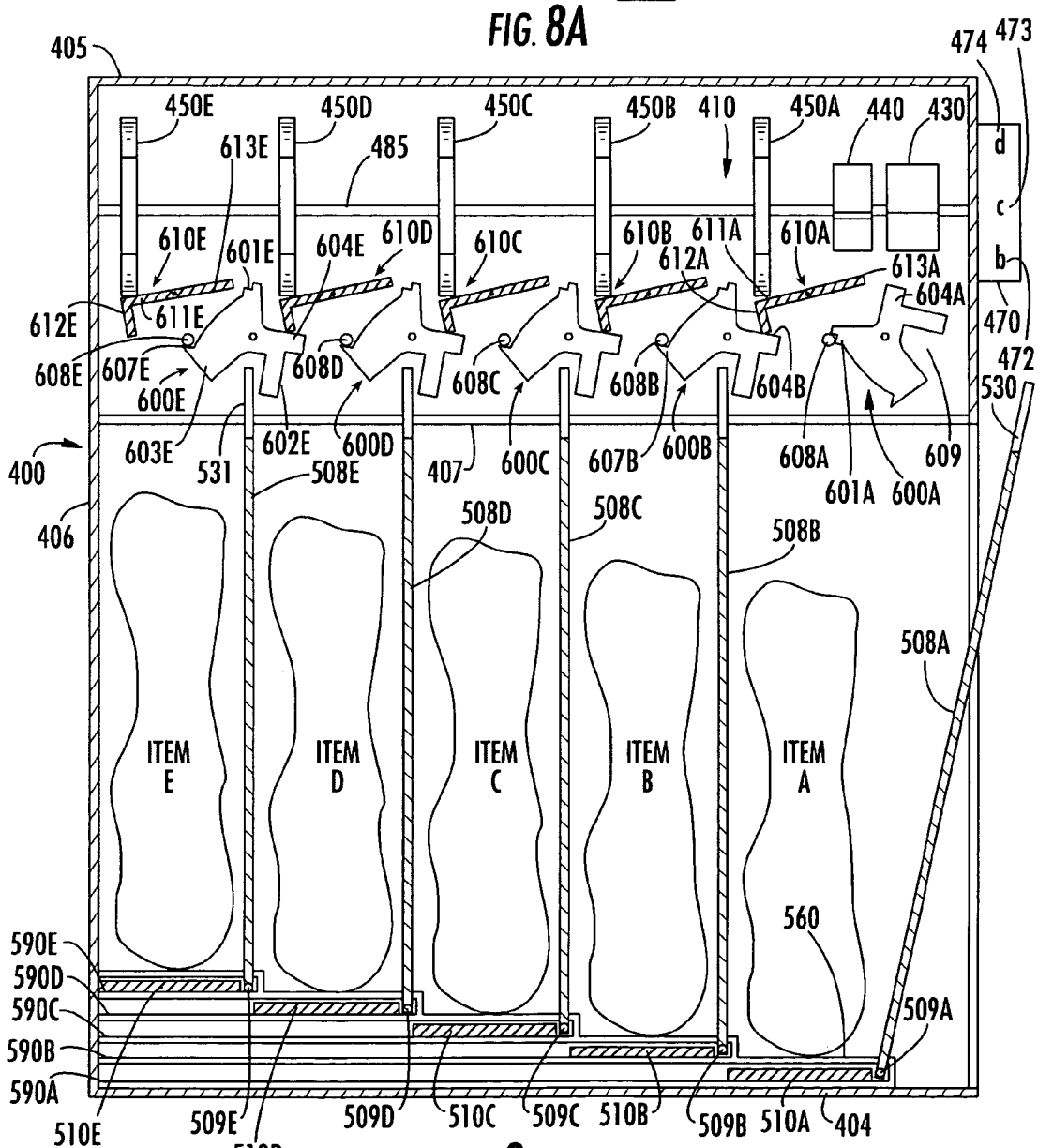

FIG. 8 is a cross-sectional view of the module shown in FIG. 3 taken along line A-A. The dispenser is shown in "dispense mode" and the outmost barrier is unlocked and in a partially open position.

FIG. 8A depicts front views of the control knob, position sensor assembly, lock assembly, and actuation device control member shown in FIG. 8.

Figure 9A:
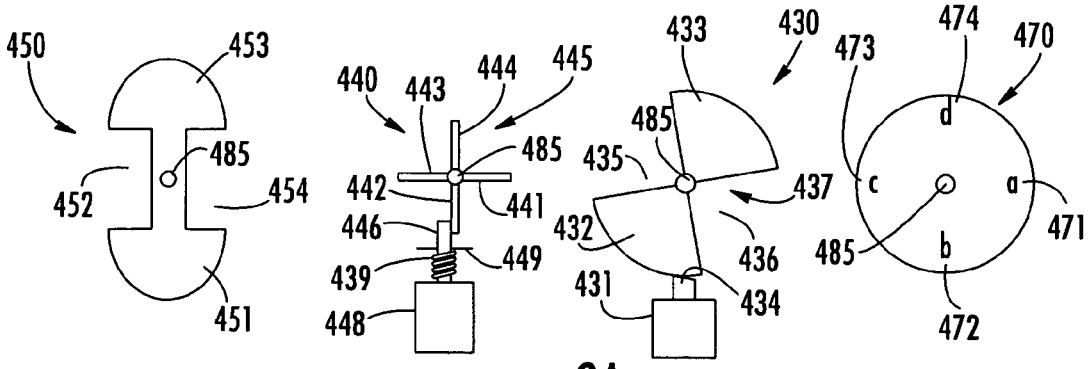
Figure 9:
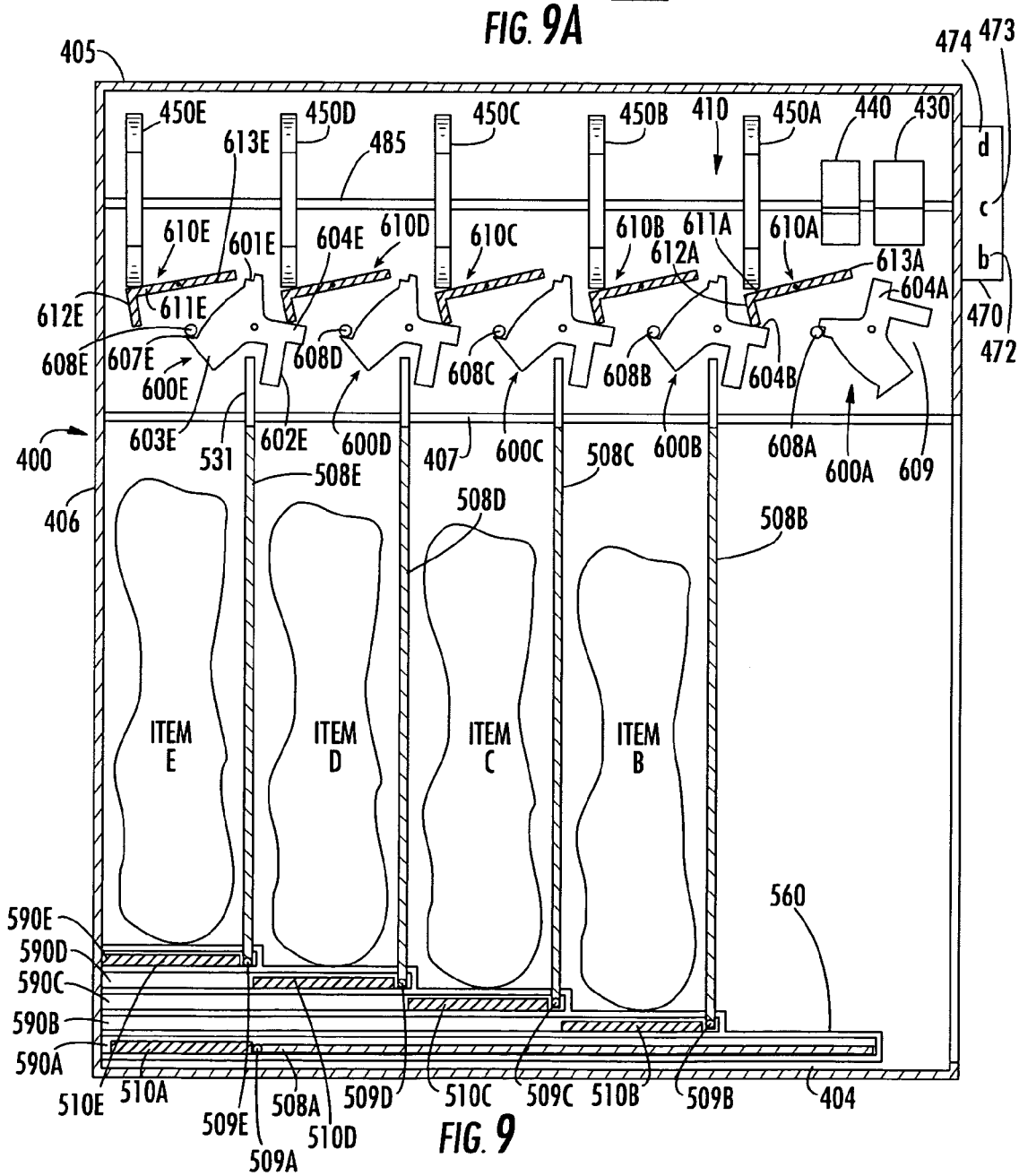

FIG. 9 is a cross-sectional view of the module shown in FIG. 3 taken along line A-A. The dispenser is shown in "dispense mode" and the outmost barrier is open and retracted into the module's bottom barrier storage compartment.

FIG. 9A depicts front views of the control knob, position sensor assembly, lock assembly, and actuation device control member shown in FIG. 9.

Figure 10A:
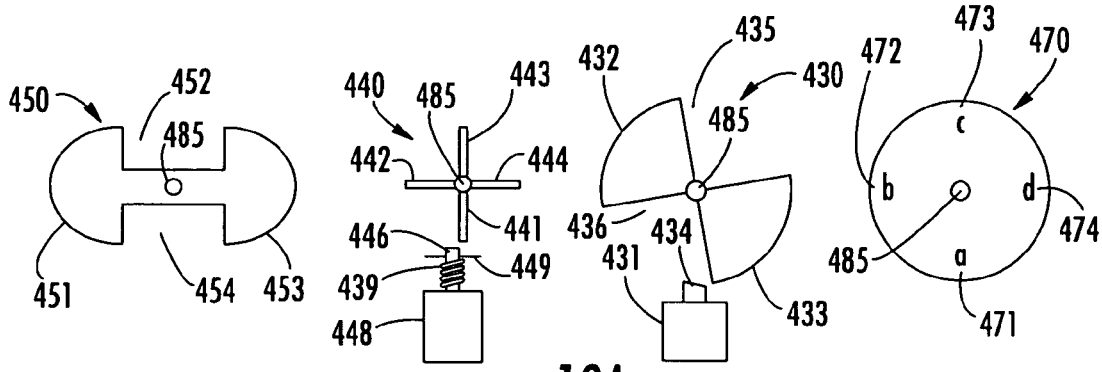
Figure 10:
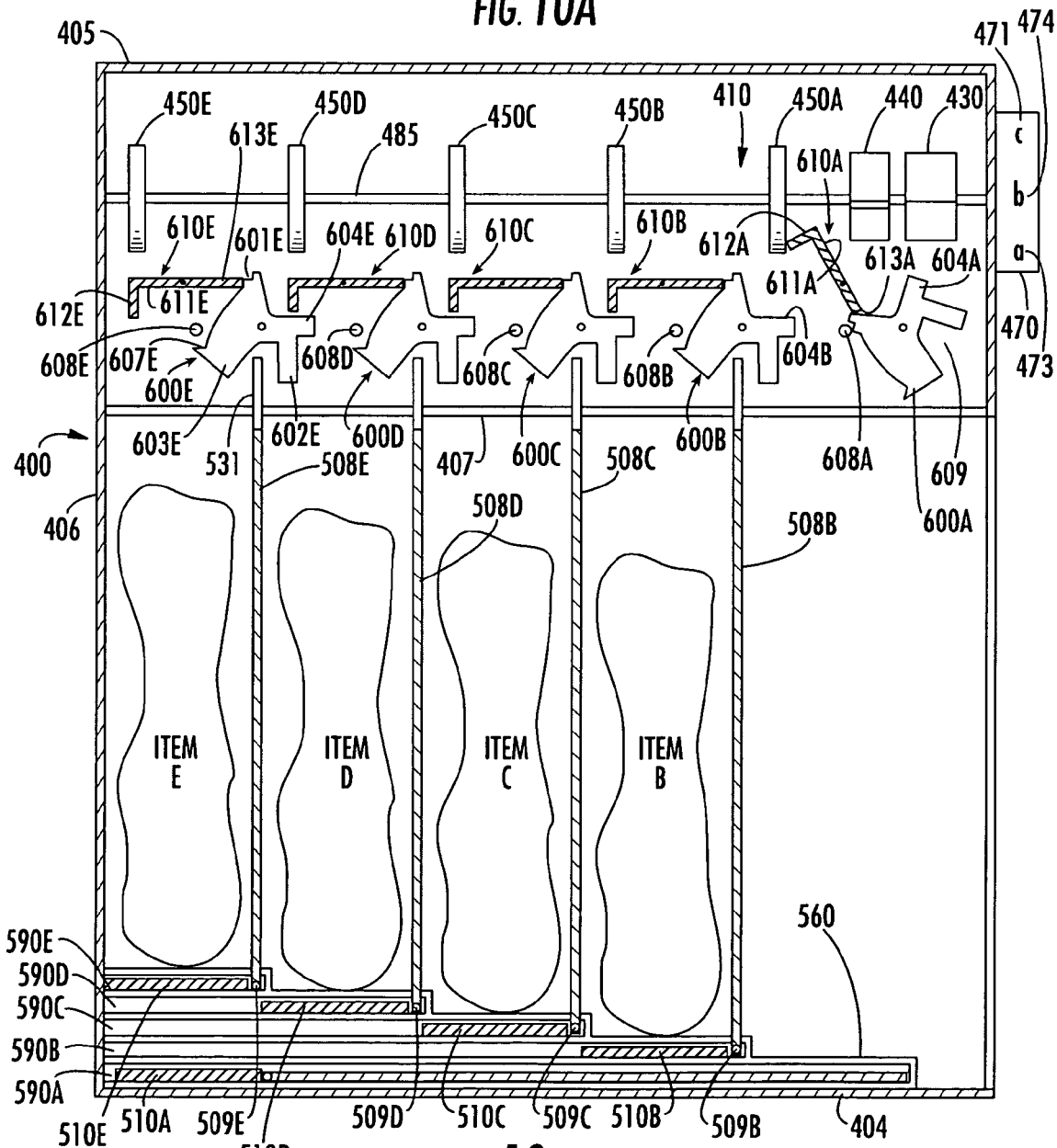

FIG. 10 is a cross-sectional view of the module shown in FIG. 3 taken along line A-A. The dispenser is shown in "dispense mode", the outmost barrier is open and retracted into the module's bottom barrier storage compartment, and the first locking member actuation device is in a "released" position.

FIG. 10A depicts front views of the control knob, position sensor assembly, lock assembly, and actuation device control member shown in FIG. 10.

Figure 11A:
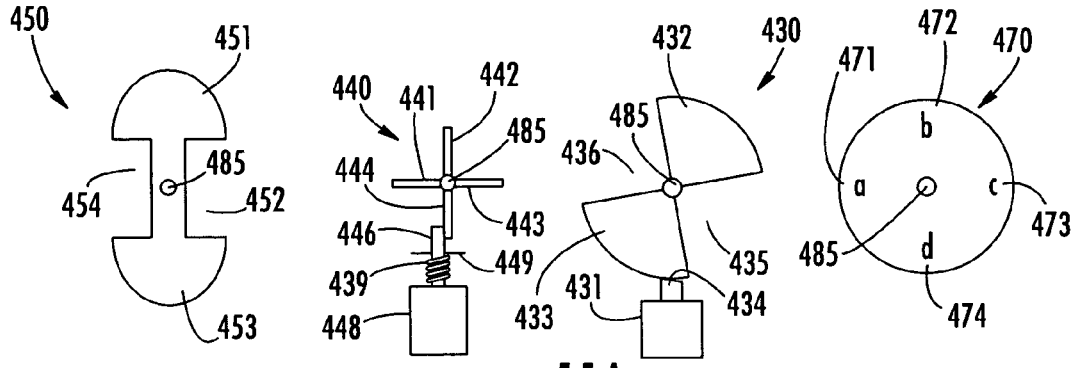
Figure 11:
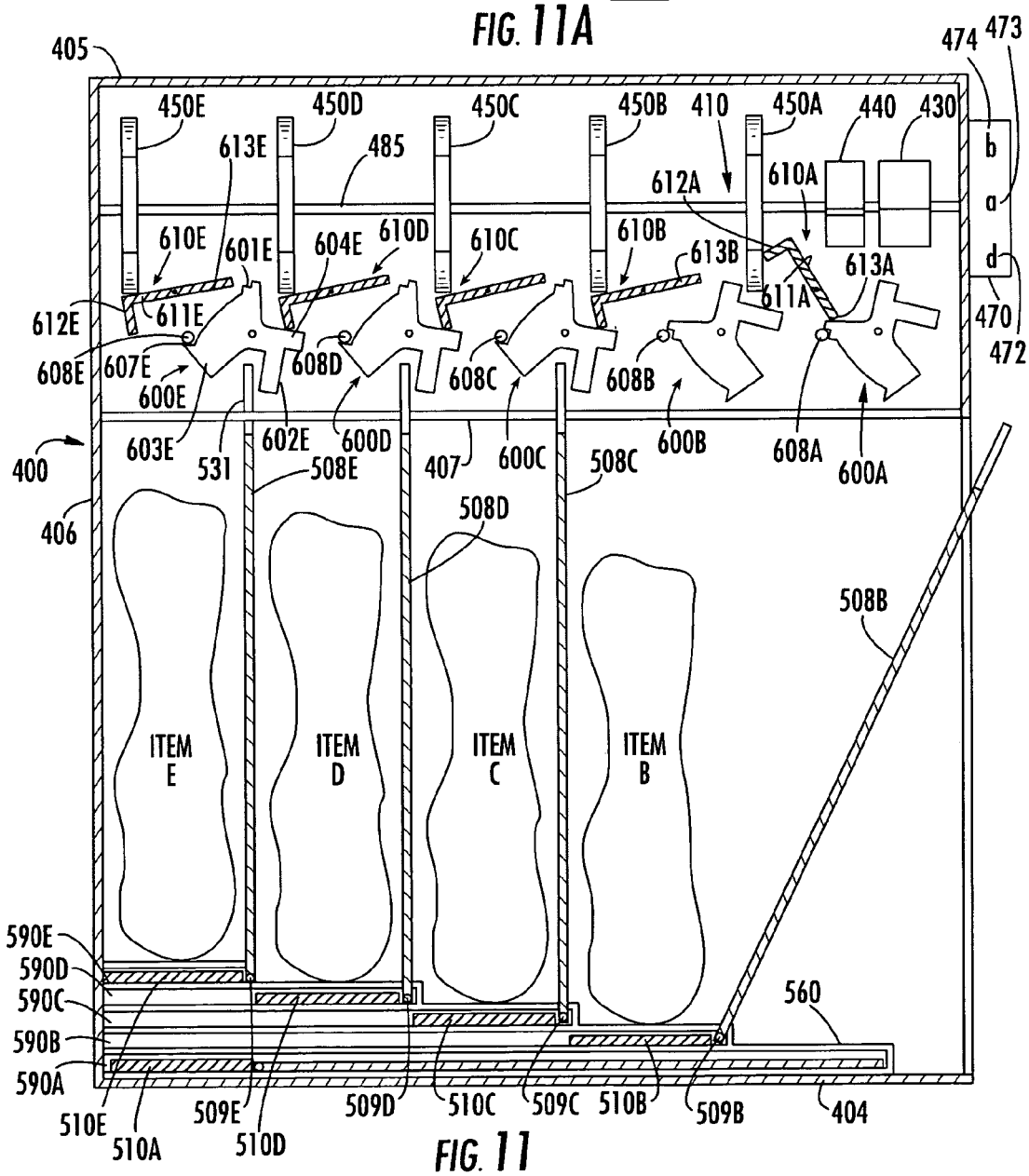

FIG. 11 is a cross-sectional view of the module shown in FIG. 3 taken along line A-A. The dispenser is shown in "dispense mode", and the second outermost barrier is unlocked in a partially open position.

FIG. 11A depicts front views of the control knob, position sensor assembly, lock assembly, and actuation device control member shown in FIG. 11.

Figure 12A:
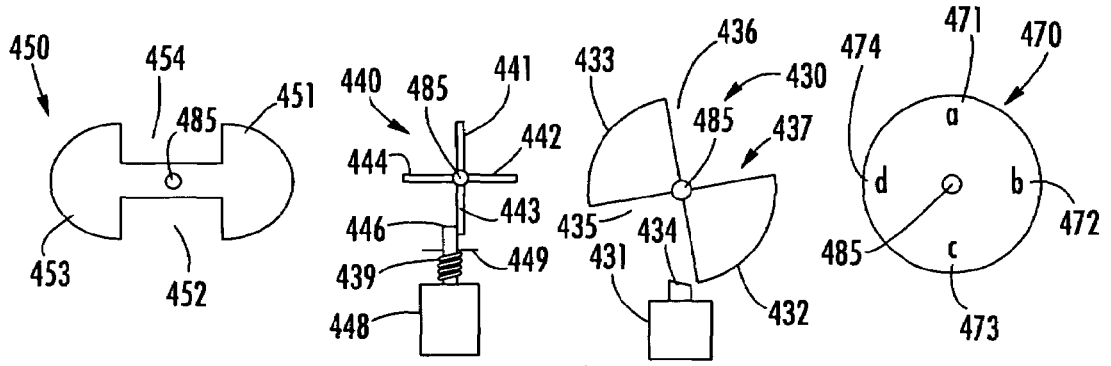
Figure 12:
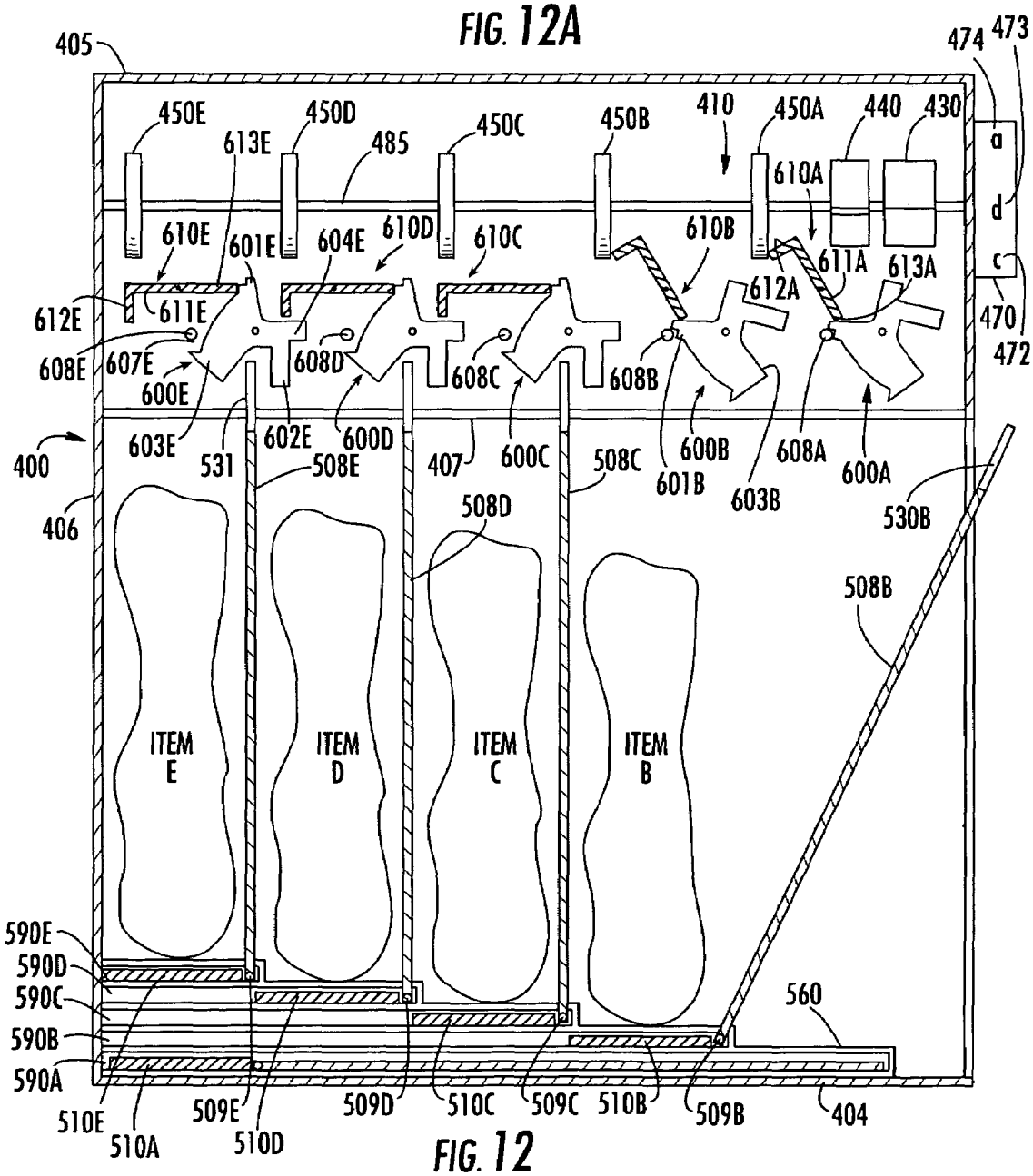

FIG. 12 is a cross-sectional view of the module shown in FIG. 3 taken along line A-A. The dispenser is shown in "load mode", the second locking member actuation device is in a released position, and the second outmost barrier is in a partially closed position.

FIG. 12A depicts front views of the control knob, position sensor assembly, lock assembly, and actuation device control member shown in FIG. 12.

Figure 13A:
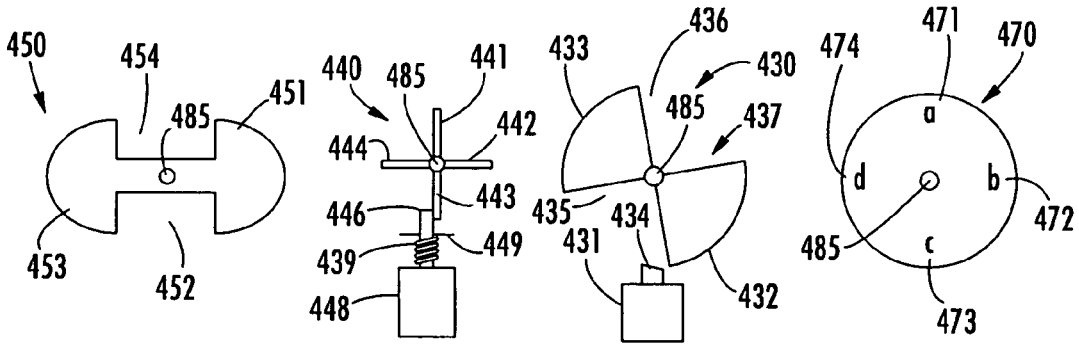
Figure 13:
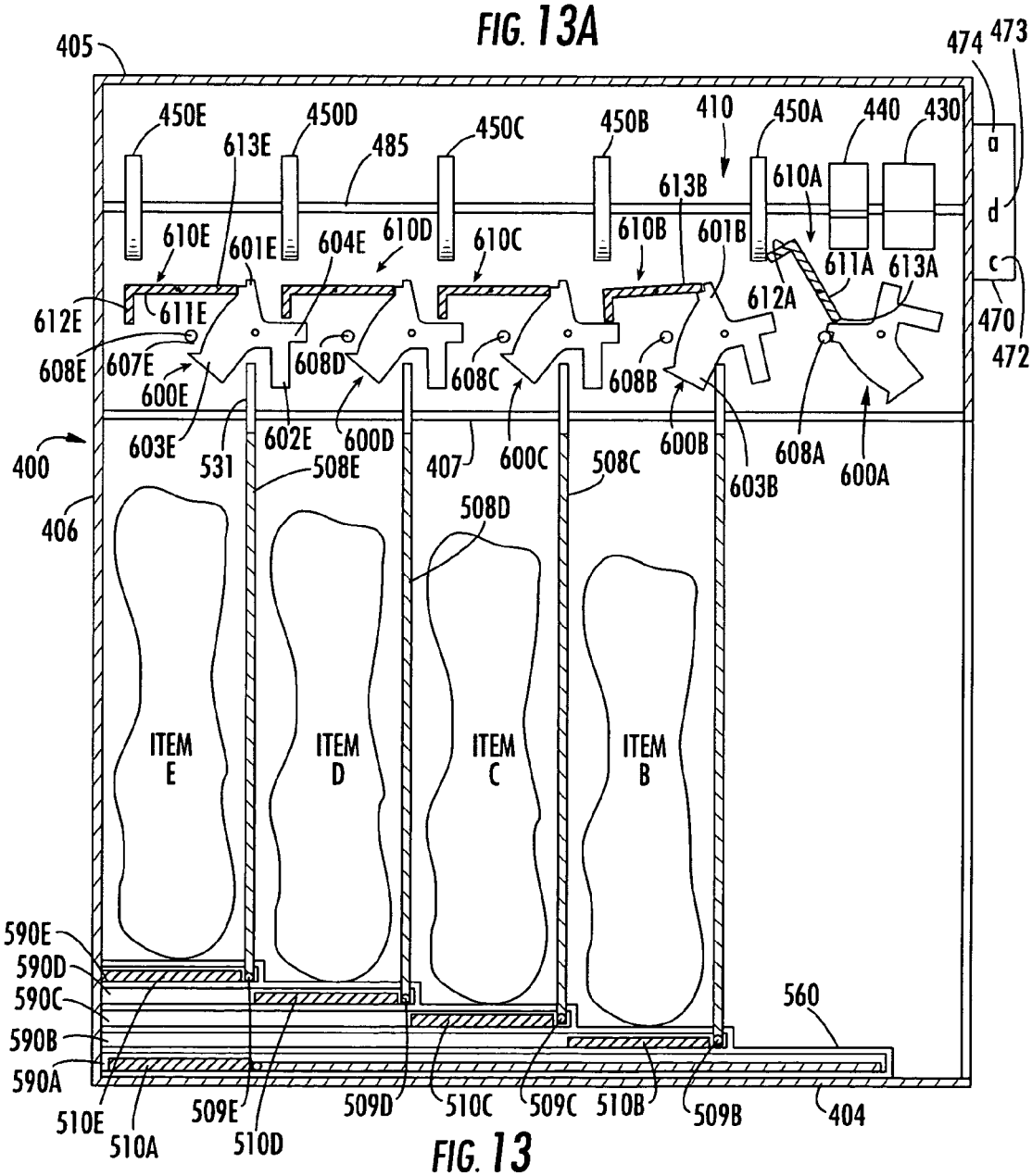

FIG. 13 is a cross-section view of the module shown in FIG. 3 taken along line A-A. The dispenser is shown in "load mode" and the second outermost barrier is approaching a closed and relocked position.

FIG. 13A depicts front views of the control knob, position sensor assembly, lock assembly, and actuation device control member shown in FIG. 13.

DETAILED DESCRIPTION OF THE INVENTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

General Structure of the Dispenser

A dispenser according to one embodiment of the invention is shown in FIGS. 1-13. As may be understood from these figures, in this embodiment of the invention, the dispenser 100 comprises five dispensing modules 400, each of which has the capacity to dispense five items (e.g., Items A-E). However, as will be understood by one skilled in the art, in various embodiments of the invention, the dispenser 100 may comprise more or less than five dispensing modules, and each dispensing module 400 may be configured to store and dispense more or less than five items.

As may be understood from FIGS. 1 and 2, a dispenser 100 according to one embodiment of the invention comprises a housing 200 that defines an interior portion and an access opening through which the dispenser's interior portion may be accessed. The dispenser 100 further comprises a door 300 that is pivotably attached adjacent the housing's access opening so that the door 300 may be moved from an open position, in which the door 300 permits access to the interior of the housing 200 through the access opening, and a closed position, in which the door 300 substantially restricts (and, in one embodiment, prevents) access to the interior of the housing 200 through the access opening.

In one embodiment of the invention, the dispenser's door 300 is provided with a handle 301 for facilitating opening and closing the door 300, and is also provided with a door lock 302 for selectively locking the door 300 in a closed position. The dispenser 100 may also comprise a card reader 201 (e.g., for reading information from a user access card, such as a smart card), and a display/input device 202 for allowing users to input information to be processed by a computer processor associated with the dispenser 100, and for displaying information to the user. As discussed below, in one embodiment of the invention, the computer processor controls access to items to be dispensed from the dispenser 100, and also tracks the dispenser's current inventory. The computer processor is preferably adapted to display information (e.g., regarding the dispenser's current inventory) on the dispenser's display/input device 202 in a manner known in the relevant field.

General Structure of the Dispensing Modules

FIG. 2 shows the dispenser 100 with its door 300 opened to expose its five dispensing modules 400, which are described in greater detail below. A closer front view of one of these dispensing modules 400 is presented in FIG. 3. As may be understood from this figure, in one embodiment of the invention, each dispensing module 400 comprises a dispensing module body that is substantially in the form of a rectangular box having an open front face. In a particular embodiment of the invention, the dispensing module body comprises a first side 402, a second side 403, a bottom portion 404, a top portion 405, a rear portion 406 and a partial front portion 401.

As may be understood from FIGS. 3 and 4, in one embodiment, the module 400 further comprises a first barrier assembly 500A adjacent the module body's partial front portion 401. In one embodiment of the invention, this first barrier assembly 500A comprises a first barrier 508A (which, in one embodiment of the invention, is substantially planar and substantially rectangular), a hinge 509A, and a base portion 510A. FIG. 4 also shows four additional barrier assemblies that are disposed generally behind the first barrier assembly 500A. In one embodiment of the invention, each of these additional barrier assemblies has essentially the same physical structure as the first barrier assembly 500A, except that the length of the various barriers 508A-508E may vary in length as shown in FIG. 4. In one embodiment of the invention, the various barriers 508A-508E within each module 500 are positioned within a substantially step-like configuration.

As may be further understood from FIG. 4, in one embodiment of the invention, each dispensing module 400 includes a plurality of barrier locking members 600A-600E, each of which, as discussed in detail below, is adapted to selectively lock a corresponding barrier 508A-508E in a closed position. In a particular embodiment, each dispensing module 400 further includes a plurality of locking member actuation devices 610A-610E that are configured to cooperate to control the movement of the various barrier locking members 600A-600E between their respective "locked" and "unlocked" orientations. As discussed in detail below, the movement of each locking member actuation device 610A-610E is controlled by a corresponding actuation device control member 450A-450E.

As may be understood from FIG. 4, each actuation device control member 450A-450E is substantially fixedly mounted adjacent a control shaft 485 so that when the control shaft 485 rotates, the control members 450A-450E rotate about the central axis of the control shaft 485. A control knob 470 is mounted adjacent the front end of the control shaft 485 so that when a user rotates the control knob 470, the control shaft 485 and control members 450A-450E rotate in unison with the control knob 470. This allows users to control the angular orientation of the various control members 450A-450E by manually rotating the control knob 470.

As described in detail below, the rotational motion of the control members 450A-450E is used to orchestrate the motion of the various locking member actuation devices 610A-610E, which in turn orchestrate the motion of the various barrier locking members 600A-600E between the locked and unlocked orientations. Accordingly, as described in detail below, users may unlock the various barriers 508A-508E by rotating the control knob 470 in a predetermined sequence.

As may be understood from FIGS. 4 and 4A, the dispensing module 400 also includes a position sensor assembly 430 that is configured for detecting changes in the control shaft's angular orientation and for transmitting this information to the dispenser's central processor. As discussed in greater detail below, in one embodiment of the invention, the position sensor assembly 430 comprises a position indicating member 437 that is mounted adjacent (and preferably to) the control shaft 485 so that the position indicating member 437 rotates in tandem with the control shaft 485. This position indicating member 437 cooperates with a position sensor 431 to track and transmit, to the dispenser's central processor, changes in the control shaft's angular orientation.

As may also be understood from FIGS. 4 and 4A, in one embodiment of the invention, the dispensing module 400 also includes a lock assembly 440 that is configured for selectively locking the control shaft 485 into various predetermined angular orientations. As discussed in greater detail below, in one embodiment of the invention, the lock assembly 440 comprises a lock member 445 that is mounted adjacent (and preferably to) the control shaft 485 so that the lock member 445 rotates in tandem with the control shaft 485. This lock member 445 cooperates with a lock control assembly 447 to restrict the movement of the control shaft 485 in a first rotational direction (e.g., a clockwise direction). In one embodiment of the invention, the control shaft 485 is attached to a ratcheting mechanism for substantially preventing the rotation of the control shaft 485 in a second rotational direction (e.g., a counterclockwise direction) that is opposite to the first rotational direction.

Specific Structure of Parts

Having described the general functionality of the various components within a dispensing module according to one embodiment of the invention, the specific structure of each of these components will now be described in greater detail. It should be understood that the structure and operation of these various components may take many different alternative forms. As noted above, the application includes several corresponding pairs of drawings (e.g., FIGS. 4 and 4A, and FIGS. 8 and 8B), which depict a cross sectional side view of the dispensing module (e.g., FIG. 4), as well as corresponding front views of the actuation device control members 450A-450E, the position sensor assembly 430, the lock assembly 440, and the control knob 470 (e.g., FIG. 4A). For ease of reference, the front view of each of the various actuation device control members 450A-450E is represented by a single generic actuation device control member 450.

Structure of the Barrier Locking Members

A barrier locking member 600 according to one embodiment of the invention is shown in FIG. 5. As may be understood from this figure, in this embodiment, the barrier locking member 600 comprises an elongate base portion 604, a lock arm stop 601 that extends generally upwardly from the base portion 604, a first leg 602 extending generally downwardly from the base portion 604, and a second leg 603 that also extends downwardly from the base portion 604. In one embodiment of the invention, the first and second legs 602, 603 are spaced apart from each other to form a recess 609 that is dimensioned for receiving a free end 530 (See FIG. 4) of a barrier 508A-508E within the recess 609. This serves to allow the barrier locking member 600 to prevent the lateral movement of the free end 530 of a barrier 508A-508E when the barrier's free end 530 is disposed within the recess 609 and the barrier locking member 600 is locked in place.

In the embodiment of the invention shown in FIG. 5, the lock arm stop 601 comprises one or more recesses that are adapted for engaging an outer surface of a locking member actuation device 610A-610E when the barrier locking member 600 is in a locked orientation. Each of these one or more recesses is also preferably configured so that when a portion of the locking member actuation device 610A-610E is disposed within the recess, the locking member actuation device 610A-610E prevents the rotational motion of the barrier locking member 600 in a particular direction (e.g., in the counterclockwise direction) about its axis of rotation 606. This allows the locking member actuation device 610A-610E to selectively lock and unlock the barrier locking member 600.

Also, as may be understood from FIG. 5, the barrier locking member 600 also preferably includes a lip 607 that extends outwardly from the second leg 603. As may be understood from FIGS. 4 and 5, this lip 607 is adapted to engage a stop 608A-608E when the barrier locking member 600A-600E is rotated clockwise to a pre-determined extent. This serves to prevent the barrier locking member 600 from being rotated clockwise past a pre-determined angular orientation.

As may be understood from FIGS. 4 and 5, an upper surface of the base portion 604 is configured to engage a portion of a locking member actuation device 610A-610E when the barrier locking member 600A-600E is in a "locked" orientation and the locking member actuation device 610A-610E is in a first orientation shown in FIG. 4. Accordingly, when a barrier locking member (e.g., barrier locking member 600A) is in a "locked" orientation and a corresponding locking member actuation device (e.g., locking member 610A) is in a first orientation shown in FIG. 4, the locking member actuation device 610A-610E prevents the counterclockwise rotation of the corresponding barrier locking member 600A-600E.

Structure of the Locking Member Actuation Devices

As may be understood from FIG. 4, in one embodiment of the invention, the various locking member actuation devices 610A-610E within a particular dispensing module 400 are essentially identical in shape and size. One such locking member actuation device (a "first" locking member actuation device 610A) is shown and labeled in FIG. 4. As may be understood from this figure, in this embodiment of the invention, this first locking member actuation device 610A is substantially L-Shaped and has an elongate base portion having a foot end 611A and a head end 613A. The locking member actuation device 610A further comprises an elongate foot portion 612A that extends outwardly from the elongate base portion's foot end 611A so that the elongate base portion's foot end 611A and the elongate foot portion 612A form an angle of about 90 degrees. In a particular embodiment of the invention, each locking member actuation device 610A-610E is substantially planar. However, in other embodiments of the invention, the various locking member actuation devices 610A-610E may not be planar.

As may be understood from FIG. 4, in one embodiment of the invention, the first locking member actuation device 610A is pivotably mounted between the first barrier locking member 600A and the second barrier locking member 600B. In one embodiment of the invention, when the first locking member actuation device 610A is in a first position shown in FIG. 4 and the first barrier locking member 600A is in a locked orientation, the head end 613A of the locking member actuation device 610A is positioned within one of the recesses of the barrier locking member's lock arm stop 601. This prevents the barrier locking member 600A from being rotated from the locked to the unlocked orientation.

Similarly, when the first locking member actuation device 610A is in a first position shown in FIG. 4 and the first barrier locking member 600A is in a locked orientation, the outward end of the first locking member actuation device's foot portion 612A engages the upper surface of the second barrier locking member's base portion 604B to prevent the counterclockwise rotation of the second barrier locking member 600B. This serves to prevent the second barrier locking member 600B from rotating from the locked to the unlocked orientation.

The first locking member actuation device 610A is also positioned so that, when the first locking member actuation device 610A is in a second position shown in FIG. 8, its head end 613A is not positioned within one of the recesses of the first barrier locking member's lock arm stop 601. Furthermore, in this position, the first locking member actuation device 610A does not physically prevent the first barrier locking member 600A from rotating from the locked orientation to the unlocked orientation.

In one embodiment of the invention, the first barrier locking member 600A is biased (e.g., via a torsion spring) to rotate counterclockwise until the first barrier locking member's lock arm stop 601 engages a stop 608A. Accordingly, in this embodiment of the invention, when the first locking member actuation device 610A moves from the first position shown in FIG. 4 into the second position shown in FIG. 8, the first barrier locking member 600A moves, in a substantially automatic manner, from the locked to the unlocked orientation and thereby releases the first barrier 508A.

In the embodiment of the invention shown in FIG. 8, when the first locking member actuation device 610A is in the second position shown in FIG. 8, the first locking member actuation device's foot portion 612A engages the upper surface of the second barrier locking member's base portion 604B to prevent the counterclockwise rotation of the second barrier locking member 600B. This serves to prevent the second barrier locking member 600B from rotating from the locked to the unlocked orientation.

As may be understood from FIG. 10, in one embodiment of the invention, the first locking member actuation device 610A is positioned so that, when the first locking member actuation device 610A is in a third position shown in FIG. 10, the first locking member actuation device's head end 613A engages a back surface of the first barrier locking member's lock arm stop 601. In addition, when the first locking member actuation device 610A is in this third position, the first locking member actuation device's foot portion 612A does not engage the upper surface of the second barrier locking member's base portion 604B.

In addition, when the first locking member actuation device 610A is in the third position shown in FIG. 10, the first locking member actuation device 610A does not prevent the second barrier locking member 600B from rotating from a locked to an unlocked orientation. As a result, as shown by FIGS. 10 and 11, when the first locking member actuation device 610A is in the third position shown in FIG. 10 and the second locking member actuation device 610B rotates into the "second position" shown in FIG. 11, the second barrier locking member 600B will rotate from the locked orientation to the unlocked orientation.

As may be understood From FIGS. 12 and 13, in one embodiment of the invention, the second barrier locking member 600B is configured so that when its corresponding barrier (i.e., the second barrier 508B) is rotated (e.g., manually) from an open to a closed position, the free end of the second barrier 508B engages the second barrier locking member's second leg 603 and, as a result, the second barrier locking member 600B rotates from the unlocked to the locked orientation.

As may also be understood from FIGS. 12 and 13, this movement of the second locking member 600B from the unlocked orientation to the locked orientation also causes the second locking member actuation device 610B to rotate back into the first position described above in reference to first locking member actuation device 610A and FIG. 4. As may be understood from FIG. 13 and the discussion above, when the second locking member actuation device 610B is in this first position and the second barrier locking member 600B is in the "locked" orientation, the second locking member actuation device 610B engages the second barrier locking member 600B to prevent the second barrier locking member 600B from rotating from a locked to an unlocked orientation.

As may be understood from FIG. 4, in one embodiment of the invention, the various barrier locking members 600A-600E are spaced uniformly apart and positioned so that their respective rotational axes lie substantially within a common plane. Similarly, the various locking member actuation devices 610A-610E are spaced uniformly apart and positioned so that their respective rotational axes 606 lie substantially within a common plane. In addition, in one embodiment, the various barrier locking members 600A-600E and locking member actuation devices 610A-610E are positioned so that each sequential pair of barrier locking members 600A-600E is separated by a corresponding locking member actuation device 610A-610E, and so that the various barrier locking members 600A-600E and the first through fourth locking member actuation devices 610A-610D interrelate as discussed above with regard to the first and second locking member actuation devices 610A, 610B and first and second barrier locking members 600A, 600B. Also, the fifth (innermost) locking member actuation device 610E is disposed inward of the innermost barrier locking member 600E so that the structural and functional relationship between the end locking member actuation device 610E and the innermost barrier locking member 600E is similar to the structural and functional relationship between the first locking member actuation device 610A and the first barrier locking member 600A.

Structure of the Actuation Device Control Member

An actuation device control member 450 according to one embodiment of the invention is shown in FIG. 4A. As may be understood from this figure, in this embodiment, the actuation device control member 450 comprises a first semicircular actuator member 451 and a second semicircular actuator member 453 that are positioned so that the respective flat portions of the first and second semicircular actuator members 451, 453 are offset from and co-facing each other. The actuation device control member 450 further includes a bridge portion 455 that extends between the respective flat portions of the first and second semicircular actuator members 451, 453. In one embodiment of the invention, the width of this bridge portion 455 is less than the length of the flat portions of the semicircular actuator members 451, 453. As a result, the actuation device control member 450 is generally H-shaped, and defines two recesses 452, 454 (called actuation device control member recesses) between the first and second semicircular actuator members 451, 453. The first of the actuation device control member recesses 452 is defined adjacent a first side of the bridge portion 455, and the second of these recesses 454 is defined adjacent a second side of the bridge portion 455 that is opposite to the bridge portion's first side.

In one embodiment of the invention, each actuation device control member 450A-450E is mounted adjacent (and preferably to) the control shaft 485 so that when the control shaft 485 rotates, the actuation device control member 450A-450E rotates to a corresponding extent about its central axis of rotation, which is substantially coaxial to the central axis of the control shaft 485.

In addition, in one embodiment of the invention, each actuation device control member 450A-450E is dimensioned and positioned so that when: (1) the actuation device control member 450A-450E is in a first (e.g., generally vertical) orientation (See FIG. 8A); and (2) a corresponding locking member actuation device 610A-610E is in the first position described above and shown in FIG. 4, the actuation device control member 450A-450E exerts a downward force on that locking member actuation device 610A-610E. In one embodiment of the invention, this force is applied adjacent the actuation device control member's foot portion 612. This causes the locking member actuation device 610A-610E to rotate counterclockwise about its pivot point.

For example, as shown in FIGS. 8 and 8A, when the first locking member actuation device 610A is in the first position shown in FIG. 4, and the first actuation device control member 450A is moved into a first (e.g., generally vertical) orientation, the first actuation device control member 450A exerts a downward force on the first locking member actuation device's foot end 611A, which causes the first locking member actuation device 610A to rotate counterclockwise about its pivot point until: (1) the first locking member actuation device's foot portion 612A engages the upper surface of the second barrier locking member's base portion 604B and thereby rotates the second barrier locking member clockwise until the second barrier locking member's lip 607 engages the second stop 608B; and (2) the first locking member actuation device's head portion 613A no longer engages the first barrier locking member's lock arm stop 601A. This serves to allow the first barrier locking member 600A to rotate counterclockwise from the locked to the unlocked orientation while maintaining the second barrier locking member 600B in the locked orientation.

In addition, in one embodiment of the invention, each actuation device control member 450A-450E is dimensioned and positioned so that when the actuation device control member 450A-450E is in a second (e.g., generally horizontal) orientation, the actuation device control member 450A-450E does not prevent a locking member actuation device 610A-610E adjacent the actuation device control member 450A-450E from rotating (e.g., clockwise) so that a portion of the locking member actuation device 610A-610E passes through one of the actuation device control member's first or second recesses 452, 454. Thus, for example, when the first actuation device control member 450A is in the second orientation shown in FIG. 10 and the first locking member actuation device 610A is in the second orientation shown in FIG. 8, the first actuation device control member 450A does not prevent the first locking member actuation device 610A from rotating from the second position to the third position discussed above.

Thus, as may be understood from the enclosed figures and the discussion below, the various actuation device control members 450A-450E and the various locking member actuation devices 610A-610E cooperate to move the current outermost locked barrier locking member from its locked orientation to its unlocked orientation as the various actuation device control members 450A-450E are rotated in a clockwise rotation. This serves to sequentially release the barriers 508A-508E beginning with the current outermost closed barrier and ending with the fifth (innermost) barrier 508E.

Structure of the Actuation Device Control System

As may be understood from FIG. 4, in one embodiment of the invention, the actuation device control system 410 includes: (1) a control shaft 485, (2) a position sensor assembly 430 for sensing the orientation of the control shaft 485 and transmitting the shaft's current orientation to the dispenser's central processor; (3) a lock assembly 440 for selectively locking the control shaft 485 in place; and (4) a control knob 470 that is shaped to facilitate the manual rotation of the control shaft 485 by a user. The structure of each of these components is described in greater detail below.

Structure of the Control Shaft

In one embodiment of the invention, the control shaft 485 is an elongate cylindrical rod that is rotatably mounted adjacent the various locking member actuation devices 610A-610E. In this embodiment, as shown in FIG. 4, the control shaft 485 is mounted to facilitate the rotation of the various actuation device control members 450A-450E between the first and second orientations described above. In one embodiment of the invention, the control shaft 485 is ratcheted so that it can only rotate in the clockwise direction.

Structure of the Position Sensor Assembly

As may be understood from FIG. 4A, in one embodiment of the invention, the position sensor assembly 430 comprises a position sensor 431 and a position indicating member 437. In a particular embodiment of the invention, the position indicating member 437 comprises a first indicator portion 432 and a second indicator portion 433. As may be understood from FIG. 4A, in one embodiment of the invention, the first and second indicator portions 432, 433 are each substantially in the shape of a quarter circle and are oriented so that the central axis of the first and second indicator portions 432, 433 lie along a common axis and so that the respective apexes of the first and second indicator portions 432, 433 are immediately adjacent each other.

As may also be understood from FIG. 4A, the first and second indicator portions 432, 433 define a first position sensor recess 435 adjacent one side of the position sensor assembly 430 and a second position sensor recess 436 adjacent an opposite side of the position sensor assembly 430. In one embodiment of the invention, the first and second position sensor recesses 435, 436 each form substantially the same shape as the first and second indicator portions 432, 433 and are also dimensioned so that the central axis of the first and second position sensor recesses 435, 436 lie along a common axis and so that the respective apexes of the first and second position sensor recesses 435, 436 are immediately adjacent each other.

As may be understood from FIG. 4A, in one embodiment of the invention, the position sensor 431 comprises a retractable sensor button 434, and the position sensor 431 is positioned so that the position indicating member 437 moves the sensor button 434 into a retracted position when either the first or the second position sensor indictor portion 432, 433 is immediately adjacent the upper portion of the position sensor 431. Similarly, the position sensor 431 is positioned so that the sensor button 434 is in an extended position when either of the first and second position sensor recesses 435, 436 is immediately adjacent the upper portion of the position sensor 431.

In a particular embodiment of the invention, the position sensor assembly 430 further comprises an electronic signal generator that transmits a "sensor button retracted" signal to the dispenser's processor when the sensor button 434 is in a retracted position. The electronic signal generator also generates a "sensor button extended" signal to the dispenser's processor when the sensor button 434 is in the extended position. Because the control shaft 485 can only rotate in the clockwise direction, these signals may be used by the processor to track the rotational movement of the control shaft 485. Because, in one embodiment of the invention, the extent of the rotation of the control shaft 485 may be directly translated into how many barriers 508A-508B have been opened to allow access to items, the information from the signal generator may be used by the dispenser's processor to determine the current inventory within the dispenser. The dispenser's processor may then display this information on the dispenser's display 202.

Structure of the Lock Assembly

As may be understood from FIG. 4A, in one embodiment of the invention, the lock assembly 440 comprises four elongate locking tabs 441-444 that extend outwardly from the control shaft 485. As may be understood from this figure, in one embodiment, the locking tabs 441-444 are spaced uniformly about the circumference of the control shaft 485 and are substantially co-planar. In a particular embodiment of the invention, each of the locking tabs 441-444 forms an angle of about 90 degrees with the control shaft's central axis 485.

In one embodiment of the invention, the lock assembly 440 further comprises a lock control assembly 447 that includes a retractable, elongate stopper member 446. In one embodiment of the invention, the lock assembly 440 is positioned so that when the elongate stopper member 446 is in an extended position, the stopper member 446 physically prevents the movement of any of the four elongate locking tabs 441-444 past the stopper member 446. Similarly, the lock assembly 440 is also positioned so that when the elongate stopper member 446 is in a retracted position, the stopper member 446 does not physically prevent the movement of any of the four elongate locking tabs 441-444 past the stopper member 446. Accordingly, because the control shaft 485 is ratcheted so that it can only move in a clockwise direction, the stopper member 446 may be used to selectively prevent users from rotating the control shaft more than 90 degrees in the clockwise direction. This serves to selectively prevent users from dispensing items from the dispenser.

In one embodiment of the invention, the lock assembly is configured to receive signals from the dispenser's processor and to selectively extend or retract the stopper member 446 in response to these signals. In this manner, the processor may cooperate with the lock assembly 440 to control user access to items within the dispenser.

Structure of the Control Knob

As may be understood from FIG. 4A, the control shaft 485 includes a control knob 470 that is disposed adjacent the control shaft 485 and that is configured so that when the control knob 470 is rotated about its central axis, the control shaft 485 also rotates about its central axis. As will be understood by one skilled in the art in light of this disclosure, the control knob 470 may be in any shape that is conducive to allowing users to grip and turn the control knob 470.

Additional Description of the Dispenser

FIG. 4 shows a dispensing module 400 in which the dispenser's control assembly 410 is positioned in "load mode". In this embodiment of the invention, when the control assembly 410 is positioned in "load mode", the various actuation device control members 450 within the dispensing module 400, are in the second (generally horizontal) orientation described above. As a result, as will be understood from the description below, any barrier locking member 600A-600E that is not maintaining a corresponding barrier 508A-508E in a locked position is free to accept the outer end 530 of a corresponding barrier 508A-508E.

In one embodiment of the invention, the control assembly 410 is in load mode when the control knob 470 is in one of two positions. More particularly, in this embodiment, the control assembly is in load mode when the control knob 470 is oriented so that the either the "a" or the "c" portion of the control knob 470 is facing upwardly.

In FIG. 4, the "a" portion of the control knob 470 is facing upwardly. At the same time, the position sensor button 434 is in an extended position because neither the first indicator portion 432 nor the second indicator portion 433 is immediately adjacent the top portion of the position sensor 431. In one embodiment of the invention, this is how the dispenser's processor (not shown) knows whether the dispensing module 400 is in load mode or in dispense mode. More particularly, in this embodiment, when the processor receives a signal indicating that a particular position sensor button 434 is in an extended position, the processor notes that the dispensing module 400 in which that particular position sensor button 434 is currently located is currently in load mode. However, when the processor receives a signal indicating that a particular position sensor button 434 is in a retracted position, the processor notes that the dispensing module 400 in which the position sensor 431 is located is currently in dispense mode.

In the configuration shown in FIG. 4, the control knob 470 (and, thus, the control shaft 485) cannot be rotated in either direction. More particularly, the control knob 470 cannot be rotated counterclockwise because, as described above, a ratchet device prevents the control shaft 485 from being rotated counterclockwise. In addition, the control knob 470 cannot be rotated clockwise because the lock assembly's stopper member 446 physically obstructs the clockwise movement of the lock assembly's third locking tab 443.

As noted above, because the control assembly 410 of FIG. 4 is in the load position, the various actuation device control members 450A-450E are in the second (substantially horizontal) orientation discussed above. Accordingly the actuation device control members 450A-450E do not engage their corresponding locking member actuation devices 610A-610E.

Operation of the Dispenser—Dispensing Items

FIGS. 4 and 8-12 will now be used to describe the operation of the dispensing module 400 as the dispensing module 400 is used to dispense items to a user. These figures depict sequential "snapshots" of one embodiment of a dispensing module 400 according to the present invention.

FIG. 8 shows a dispensing module 400 in which the dispensing module's first (outermost) barrier 508A has been unlocked and rotated toward an open position in which a user will have access to Item A, which is immediately adjacent the rear face of the first barrier 508A.

In order to move the dispensing module 400 into the position shown in FIG. 8 (e.g., to obtain access to Item A), an authorized user first slides their identification card through the dispenser's card reader 201 (See FIG. 1) and uses the dispenser's display/input device 202 to request a particular item (e.g., a particular size of surgical scrub shirt or pants). The dispenser's processor (not shown) then sends a signal to unlock the dispenser's door 300, which the user then opens to access the various dispensing modules 400.

The dispenser's processor also sends a signal to the dispensing module 400 that contains the item desired by the user to activate the lock assembly's solenoid 448. This causes the lock assembly's stopper member 446 to retract and thereby permit the control shaft 485 (and, thus, the control knob 470) to be rotated in a clockwise direction. The processor then lights an LED 481 (See FIG. 3) on the dispensing module 400 to indicate that the user may retrieve the requested item from that particular dispensing module 400 by rotating the dispensing module's control knob 470 clockwise until it stops.

The user then uses the lighted LED 481 to identify the dispensing module 400 as the appropriate dispensing module 400 from which to retrieve the requested item. The user then begins to rotate the control knob 470 clockwise which serves to also rotate, in a clockwise direction, the position indicator member 437, the lock member 445, and the various actuation device control members 450A-450E.

As a result of the clockwise rotation of the position indicator member 437, the first indicator portion 432 moves immediately adjacent the top surface of the position sensor assembly 430 (See FIG. 8A), which causes the position sensor button 434 to retract. The position sensor assembly 430 then sends a signal to the dispenser's processor indicating that the position sensor button 434 is in the retracted position. In response to receiving this signal, the processor sends a signal to the lock assembly 440 indicating that the stopper member 446 should be moved into the extended position. In response to receiving this signal, the lock assembly 440 allows the spring retainer 449 to move the stopper member 446 into the extended position.

The user then continues to rotate the control knob 470 until the second locking tab 442 is stopped by stopper member 446 (See FIG. 8A). At this point, the first actuation device control member 450A has rotated to the point where its first actuator member 451 is pushing down on the foot portion 611A of the first locking member actuation device 610A. As a result, the first locking member actuation device 610A rotates from the first position described above, to the second position shown in FIG. 8. As noted above, in this position, the first locking member actuation device's head portion 613A no longer engages the first barrier locking member's lock arm stop 601A. This serves to allow the first barrier locking member 600A to rotate counterclockwise from the locked to the unlocked orientation while the foot portion of the first locking member actuation device 612A maintains the second barrier locking member 600B in the locked orientation. As may be understood from FIG. 8, when the dispensing module 400 is in this configuration, the third, fourth, and fifth barrier locking members 600C, 600D, 600E are maintained, respectively, in a locked orientation by the second, third, and fourth locking member actuation devices 610B, 610C, 610D. Accordingly, the second through fifth barriers 508B-508E are secured in a closed position.

As the dispenser progresses from the configuration shown in FIG. 8 to the configuration shown in FIG. 9, the first barrier 500A is fully opened and then slid back into the dispensing module 400. More particularly, a user rotates the first barrier 508A about the first hinge 509A until the first barrier 508A is in an approximately horizontal position. The user then pushes the first barrier 508A toward the dispenser, which causes the first base portion 510A, the first hinge 509A and the first barrier 508A to slide back into the dispensing module so that the first base portion 510A, the first hinge 509A and the first barrier 508A are disposed in a substantially horizontal orientation generally beneath the second through fifth barriers 508B-508E. Accordingly, when the first barrier 508A is in this position, Item A is fully accessible to the user, who may remove Item A from the dispensing module 400 at their convenience.

FIGS. 9, 10 and 11 depict the dispensing of a second item (Item B). FIG. 9 shows the configuration of the dispensing module 400 after the first item (Item A) has been dispensed from the dispenser. When a next authorized user wants a particular item from this same dispensing module 400, this next user slides their identification card through card reader 201 (See FIG. 1) and uses the dispenser's display/input device 202 to request the particular item (e.g., a particular size of surgical scrub shirt or pants). The dispenser's processor (not shown) then sends a signal to unlock the dispenser's door 300, which the user then opens to access the various dispensing modules 400.

The dispenser's processor also sends a signal to the dispensing module 400 (which contains the item desired by the user) to activate the lock assembly's solenoid 448. This causes the lock assembly's stopper member 446 to retract (See FIG. 10A) and thereby permit the control shaft 485 (and, thus, the control knob 470) to be rotated in a clockwise direction. The processor then lights an LED 481 (See FIG. 3) on the dispensing module 400 to indicate that the user may retrieve the requested item from that particular dispensing module 400 by rotating the dispensing module's control knob 470 clockwise until it stops. The user then begins to rotate the control knob 470 clockwise which serves to also rotate, in a clockwise direction, the position indicator member 437, the locking member 445, and the various actuation device control members 450A-450E.

As a result of the clockwise rotation of the position indicator member 437, the second position sensor recess 436 is moved adjacent the top surface of the position sensor assembly 430, which causes the position sensor button 434 to extend into the second position sensor recess 436 (See FIG. 10A). The position sensor assembly 430 then sends a signal to the dispenser's processor indicating that the position sensor button 434 is in the extended position.

The user then continues to rotate the control knob 470 until the first actuation device control member 450A has rotated into the second (horizontal) orientation described above (See FIGS. 10 and 10A). As noted above, when the first actuation device control member 450A is in this orientation, the first actuation device control member 450A does not prevent the first locking member actuation device 610A from rotating from the second position to the third position discussed above. As noted above, in this third position, the first locking member actuation device's head end 613A engages a back surface of the first barrier locking member's lock arm stop 601. In addition, when the first locking member actuation device 610A is in this third position, the first locking member actuation device's foot portion 612A does not engage the upper surface of the second barrier locking member's base portion 604B and, thus, does not prevent the second barrier locking member 600B from rotating from a locked to an unlocked orientation.

The user then continues to rotate the control knob 470 clockwise. As shown in FIGS. 11 and 11A, as a result of the clockwise rotation of the position sensor assembly's first and second indicator portions 432, 433, the second indicator portion 433 moves adjacent the top surface of the position sensor button 434, which causes the position sensor button 434 to retract. The position sensor assembly 430 then sends a signal to the dispenser's processor indicating that the position sensor assembly 430 is in the retracted position. In response to receiving this signal, the processor sends a signal to the lock assembly 440 indicating that the stopper member 446 should be moved into the extended position. In response to receiving this signal, the lock assembly 440 allows the spring retainer 449 to move the stopper member 446 into the extended position.

The user then continues to rotate the control knob 470 until the fourth locking tab 444 is stopped by stopper member 446 as shown in FIG. 11A. At this point, the second actuation device control member 450B has rotated to the point where its second actuator member 453 is pushing down on the foot portion 611 of the second locking member actuation device 610B. As a result, the second locking member actuation device 610B rotates from the first position described above to the second position shown in FIG. 11. As noted above, in this position, the second locking member actuation device's head portion 613B no longer engages the second barrier locking member's lock arm stop 601. This serves to allow the second barrier locking member 600B to rotate counterclockwise from the locked to the unlocked orientation while the second locking member actuation device 610B maintains the third barrier locking member 600C in the locked orientation.

As may be understood from FIG. 11, the fourth, and fifth barrier locking members 600D, 600E are maintained, respectively, in a locked orientation by the third, and fourth locking member actuation devices 610C, 610D. Accordingly, when the dispenser is in this configuration, the third through fifth barriers 508C-508E are secured in a closed position.

The second barrier 508B may then be fully opened and then slid back into the dispensing module 400. More particularly, a user rotates the second barrier 508B about the second hinge 509B until the second barrier 508B is in an approximately horizontal position. The user then pushes the second barrier 508B toward the dispenser, which causes the second base portion 510B, the second hinge 509B and the second barrier 508B to slide back into the dispensing module so that the second base portion 510B, the second hinge 509B and the second barrier 508B are disposed in a substantially horizontal orientation beneath the third through fifth barriers 508C-508E. Accordingly, when the second barrier 508B is in this position, Item B is fully accessible to the user, who may remove Item B from the dispenser at their convenience.

To dispense additional items from this dispensing module 400, the procedure described above in regard to dispensing Items A and B may be repeated until the desired items are dispensed.

Operation of the Dispenser—Loading Items

The procedure used to load the dispensing module 400 will now be described. For the purposes of clarity, the loading procedure will be described with regard to FIGS. 11 and 12 in the context of loading a single dispensing module 400. However, as will be understood by one skilled in the relevant field, in one embodiment, similar techniques may be used to load any of the dispenser's dispensing modules 400.

To load a dispensing module 400, a "loader person" (which is a particular type of user who is authorized to load the dispenser 100) slides their ID card through the dispenser's card reader 201 and indicates (e.g., using the dispenser's display/input device 202) that they would like to load the dispenser with a particular type of item. In response to receiving this indication, the dispenser's processor (not shown) then sends a signal to unlock the dispenser's door 300, which the loader person then opens to access the various dispensing modules 400.

The dispenser's processor also identifies the dispensing module 400 (or modules) to be loaded and determines whether the dispensing module 400 is currently in a load or a dispense configuration. In one embodiment of the invention, the dispenser does this by polling the position sensor assembly 430 to determine whether the position sensor button 434 is in the extended or the retracted position. As noted above, in one embodiment, if the position sensor button 434 is in the extended position, the dispensing module 400 will be in the load configuration (e.g., the dispensing module's various actuation device control members 450A-450E are in the second, substantially horizontal, configuration described above). However, if the position sensor button 434 is in the retracted position, the dispensing module 400 will be in the dispense configuration (e.g., the dispensing module's various actuation device control members 450A-450E are in the first, substantially vertical, configuration described above).

If the dispenser's processor determines that the dispensing module 400 is in dispense mode, the processor sends a signal to activate the dispensing module's lock assembly solenoid 448. This causes the dispensing module's stopper member 446 to retract and thereby permit the control shaft 485 (and, thus, the control knob 470) to be rotated in a clockwise direction. The processor then lights an LED 481 (See FIG. 3) on the dispensing module 400 to indicate that the user may load that particular dispensing module 400 by rotating the dispensing module's control knob 470 clockwise until it stops.

The loader person then uses the lighted LED 481 to identify the dispensing module 400 as the appropriate dispensing module 400 to load. Next, the loader person begins to rotate the control knob 470 clockwise which serves to also rotate, in a clockwise direction, the position sensor indicator member 437, the locking member 445, and the various actuation device control members 450A-450E.

As a result of the clockwise rotation of the position sensor assembly's position indicator member 437, the first position sensor recess 435 moves immediately adjacent the top surface of the position sensor assembly 430, which causes the position sensor button 434 to extend. The position sensor assembly 430 then sends a signal to the dispenser's processor indicating that the position sensor button 434 is in the extended position. In response to receiving this signal, the processor sends a signal to the lock assembly 440 indicating that the stopper member 446 should be moved back into the extended position. In response to receiving this signal, the lock assembly 440 allows the spring retainer 449 to move the stopper member 446 into the extended position. The user then continues to rotate the control knob 470 until the next locking tab 441-444 is stopped by the stopper member 446. Once the control knob 470 is stopped in this position, the actuation device control members will have rotated clockwise 90 degrees and the dispensing module will be in the load configuration. The dispenser is now ready to be loaded by the user.

If, after the user slides their ID card through the card reader 201 and indicates that they would like to load the dispenser, the dispenser's processor determines that the dispensing module already in load mode, the dispenser's processor does not retract the stopper member 446 as described above. Rather, the processor maintains the stopper member 446 in the extended position so that the control knob 470 will not rotate in response to the user attempting to rotate it. This will serve to convey to the user that the dispensing module 400 is already in the load position and ready to be loaded.

Once the dispensing module 400 is in the load position, the user may manually slide the various "opened" barriers 508A-508E from their stored positions and rotate the barriers 508A-508E about their respective hinges 509A-509E until the barriers 508A-508E move into the closed and locked position shown in FIG. 4.

FIGS. 12 and 13 depict the loading of a storage compartment defined between barriers 508B and 508C. Although the below discussion describes the loading of an item behind the second barrier 508B, it should be understood that a similar process could be used to load items behind any of the dispenser's other barriers 508A-508E.

As may be understood from FIG. 12, to load an item (here Item B) into the compartment defined by the second and third barriers 508B, 508C, the user first slides the second barrier 508B horizontally from its storage compartment 590B and then rotates the second barrier 508B about its respective hinge 509B toward the closed position. As the second barrier 508B moves into the closed position, the free end 530B of the second barrier 508B contacts the interior surface of the second leg 603B of the second barrier locking member 600B. This causes the second barrier locking member 600B to rotate clockwise toward its locked orientation.

This rotation of the second barrier locking member 600B toward the locked orientation causes the second barrier locking member's lock arm stop 601B to exert a force on the head end 613B of the second locking member actuation device 610B (which is in contact with the second barrier locking member's lock arm stop 601). This causes the second locking member actuation device 610B to rotate counterclockwise about its pivot point until the head end 613B of the second locking member actuation device 610B is disposed within the recess 605 of the second barrier locking member's lock arm stop 601B as shown in FIG. 13. This serves to maintain the second barrier locking member 600B in the locked position in the manner described above. As a result, the second barrier 508B is maintained in a closed orientation in which the second barrier 508B prevents user access to Item B.

As may be understood by one skilled in the art, the above techniques may be used to load additional items into the dispensing module 400. In one embodiment of the invention, items are preferably loaded one at a time starting with the innermost empty compartment and continuing outwardly to adjacent compartments until all desired items are loaded.

In one embodiment of the invention, each of the barriers 508A-508E includes a number printed on its outer surface (See e.g., FIG. 2) to indicate the number of the compartment to which the barrier 508A-508E controls immediate access. In one embodiment of the invention, the various compartments are numbered from 1 to 5 beginning with the innermost compartment (e.g., the compartment that is defined, in part, by the fifth barrier 508E) and ending with the outermost compartment (e.g., the compartment that is defined by the first and second barriers 508A, 508B). In this embodiment, once the user has loaded all of the desired items into a particular dispensing module 400, the user then uses the dispenser's display/input device 202 to enter the number printed on the exterior surface of the outermost closed barrier 508A-508E. For example, in the embodiment of the invention shown in FIG. 2, the user would enter the number "5". The processor can then use this information to determine and store in memory how many items have been loaded into the dispenser, and to thereby maintain a running inventory of the items within the dispenser.

Additional Aspects of the Invention

In addition, in one embodiment of the invention, a spring or other appropriate retraction device may be included to automatically pull the various barriers 508A-508E back into the dispensing module 400 after the various barriers 508A-508E move into the fully open position rather than requiring the user to manually push the barriers 508A-508E back into the dispensing module 400.

Also, in a particular embodiment of the invention, instead of requiring a user to input the number of items available to dispense for each dispensing module 400, an automatic load detection system could be used to determine the number of items that have been loaded into the dispensing module 400. For example, a switch could be placed adjacent each barrier 508A-508E or adjacent each barrier locking member 600A-600E to indicate to the processor how many barriers 508 are currently locked in each dispensing module 400.

CONCLUSION

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

I claim:

1. A dispenser comprising:

a first barrier disposed within said dispenser;

a second barrier disposed within said dispenser, said second barrier being spaced apart from said first barrier, and wherein:

said first and second barriers at least partially define a first item-receiving space between said first and second barriers, said second barrier at least partially defines a second item-receiving space behind said second barrier, said first barrier is adapted to move between: (A) a first-barrier-closed position in which said first barrier substantially restricts access to said first item-receiving space, and (B) a first-barrier-open position in which said first barrier is positioned to permit access to said first item-receiving space, and said second barrier is adapted to move between: (A) a second-barrier-closed position in which said second barrier substantially restricts access to said second item-receiving space, and (B) a second-barrier-open position in which said second barrier is positioned to permit access to said second item-receiving space, wherein:

said first barrier is in a substantially vertical orientation when said first barrier is in said first-barrier closed position; and said second barrier is in a substantially vertical orientation when said second barrier is in said second-barrier closed position.

2. The dispenser of claim 1, wherein:

said first barrier has a front surface and a rear surface;

said second barrier has a front surface and a rear surface; and when said first barrier is in said first-barrier-closed position and said second barrier is in said second-barrier-closed position, said rear surface of said first barrier and said front surface of said second barrier are co-facing.

3. The dispenser of claim 1, wherein when said first barrier is in said first-barrier-closed position, said first barrier also substantially restricts access to said second barrier.

4. The dispenser of claim 1, wherein when said first barrier is in said first-barrier-closed position, said first barrier also substantially restricts access to said second item-receiving space.

5. The dispenser of claim 1, wherein:

said dispenser comprises a third barrier; and said first, second, and third barriers are positioned in a substantially horizontal array.

6. The dispenser of claim 1, wherein said first barrier is mounted to pivot between said first-barrier-closed position and said first-barrier-open position.

7. The dispenser of claim 6, wherein said first barrier is mounted to at least partially retract into a first recess after being pivoted into said first-barrier-open position.

8. The dispenser of claim 7, wherein said first barrier is mounted to at least partially retract into said first recess until said first barrier is disposed substantially entirely within said first recess.

9. The dispenser of claim 1, wherein in said first barrier is substantially planar.

10. The dispenser of claim 9, wherein said second barrier is substantially planar.

11. The dispenser of claim 1, wherein:

said first item-receiving space is dimensioned to store a first item to be dispensed from said dispenser;

said first barrier is adapted to prevent customer access to said first item when said first barrier is in said first-barrier-closed position; and said first barrier is adapted to permit customer access to said first item when said first barrier is in said first-barrier-open position.

12. The dispenser of claim 11, wherein:

said second item-receiving space is dimensioned to store a second item to be dispensed from said dispenser;

said second barrier is adapted to prevent customer access to said second item when said second barrier is in said second-barrier-closed position; and said second barrier is adapted to permit customer access to said second item when said second barrier is in said second-barrier-open position.

13. The dispenser of claim 1, wherein said first barrier is parallel to and offset from said second barrier when said first barrier is in said first-barrier-open position and said second barrier is in said second-barrier-open position.

14. The dispenser of claim 1, wherein:

said first item-receiving space is dimensioned to store a first item to be dispensed from said dispenser;

said second item-receiving space is dimensioned to store a second item to be dispensed from said dispenser;

said first barrier is adapted to prevent customer access to said first item when said first barrier is in said first-barrier-closed position;

said first barrier is adapted to permit customer access to said first item when said first barrier is in said first-barrier-open position;

said second barrier is adapted to prevent customer access to said second item when said second barrier is in said second-barrier-closed position; and said second barrier is adapted to permit customer access to said second item when said second barrier is in said second-barrier-open position.

15. The dispenser of claim 1, wherein said dispenser further comprises:

a first barrier locking member for selectively locking said first barrier in said first-barrier-closed position.

16. The dispenser of claim 15, wherein said first barrier locking member is positioned adjacent a free end of said first barrier to selectively restrict the movement of said first barrier into said first-barrier-open position.

17. The dispenser of claim 1, wherein:

said dispenser further comprises a third barrier that is positioned so that said third barrier is spaced apart from said second barrier;

said second and third barriers at least partially define said second item-receiving space between said second and third barriers;

said third barrier at least partially defines a third item-receiving space behind said third barrier; and said third barrier is adapted to move between: (A) a third-barrier-closed position in which said third barrier substantially restricts access to said third item-receiving space, and (B) a third-barrier-open position in which said third barrier is positioned to permit access to said third item-receiving space.

18. The dispenser of claim 17, wherein a rear surface of said second barrier and a front surface of said third barrier are co-facing when said second barrier is in said second-barrier-closed position and said third barrier is in said third-barrier-closed position.

19. The dispenser of claim 17, wherein when said second barrier is in said second-barrier-closed position, said second barrier also substantially restricts access to said third barrier.

20. The dispenser of claim 17, wherein said first, second, and third barriers are substantially planar.

21. A dispenser comprising:

a first barrier disposed within said dispenser;

a second barrier disposed within said dispenser, said second barrier being spaced apart from said first barrier, and wherein:

said first and second barriers at least partially define a first item-receiving space between said first and second barriers, said second barrier at least partially defines a second item-receiving space behind said second barrier, said first barrier is adapted to move between: (A) a first-barrier-closed position in which said first barrier substantially restricts access to said first item-receiving space, and (B) a first-barrier-open position in which said first barrier is positioned to permit access to said first item-receiving space, said second barrier is adapted to move between: (A) a second-barrier-closed position in which said second barrier substantially restricts access to said second item-receiving space, and (B) a second-barrier-open position in which said second barrier is positioned to permit access to said second item-receiving space, said first barrier is mounted to at least partially retract into a first recess after being pivoted into said first-barrier-open position, and said second barrier is mounted to retract into a second recess after being pivoted into said second-barrier-open position.

22. The dispenser of claim 21, wherein said second barrier is mounted to retract into said second recess until said second barrier is disposed substantially entirely within said second recess.

23. A dispenser comprising:

a first barrier disposed within said dispenser;

a second barrier disposed within said dispenser, said second barrier being spaced apart from said first barrier, and wherein:

said first and second barriers at least partially define a first item-receiving space between said first and second barriers, said second barrier at least partially defines a second item-receiving space behind said second barrier, said first barrier is adapted to move between: (A) a first-barrier-closed position in which said first barrier substantially restricts access to said first item-receiving space, and (B) a first-barrier-open position in which said first barrier is positioned to permit access to said first item-receiving space, said second barrier is adapted to move between: (A) a second-barrier-closed position in which said second barrier substantially restricts access to said second item-receiving space, and (B) a second-barrier-open position in which said second barrier is positioned to permit access to said second item-receiving space, said first barrier is mounted to at least partially retract into a first recess after being pivoted into said first-barrier-open position, said first barrier is mounted to retract into said first recess until said first barrier is disposed substantially entirely within said first recess; and said second barrier is mounted to retract into a second recess until said second barrier is disposed substantially entirely within said second recess.

24. A dispenser comprising:

a first barrier disposed within said dispenser;

a second barrier disposed within said dispenser, said second barrier being spaced apart from said first barrier, and wherein:

said first and second barriers at least partially define a first item-receiving space between said first and second barriers, said second barrier at least partially defines a second item-receiving space behind said second barrier, said first barrier is adapted to move between: (A) a first-barrier-closed position in which said first barrier substantially restricts access to said first item-receiving space, and (B) a first-barrier-open position in which said first barrier is positioned to permit access to said first item-receiving space, said second barrier is adapted to move between: (A) a second-barrier-closed position in which said second barrier substantially restricts access to said second item-receiving space, and (B) a second-barrier-open position in which said second barrier is positioned to permit access to said second item-receiving space, said first barrier is mounted to at least partially retract into a first recess after being pivoted into said first-barrier-open position, said first barrier is mounted to slideably retract into said first recess until said first barrier is disposed substantially entirely within said first recess; and said second barrier is mounted to slideably retract into a second recess until said second barrier is disposed substantially entirely within said second recess.

25. A dispenser comprising:

a first barrier disposed within said dispenser;

a second barrier disposed within said dispenser, said second barrier being spaced apart from said first barrier, and wherein:

said first and second barriers at least partially define a first item-receiving space between said first and second barriers, said second barrier at least partially defines a second item-receiving space behind said second barrier, said first barrier is adapted to move between: (A) a first-barrier-closed position in which said first barrier substantially restricts access to said first item-receiving space, and (B) a first-barrier-open position in which said first barrier is positioned to permit access to said first item-receiving space, said second barrier is adapted to move between: (A) a second-barrier-closed position in which said second barrier substantially restricts access to said second item-receiving space, and (B) a second-barrier-open position in which said second barrier is positioned to permit access to said second item-receiving space, and said second barrier is mounted to retract into a second recess after being pivoted into said second-barrier-open position.

26. A dispenser comprising:

a first barrier disposed within said dispenser;

a second barrier disposed within said dispenser, said second barrier being spaced apart from said first barrier, and wherein:

said first and second barriers at least partially define a first item-receiving space between said first and second barriers, said second barrier at least partially defines a second item-receiving space behind said second barrier, said first barrier is adapted to move between: (A) a first-barrier-closed position in which said first barrier substantially restricts access to said first item-receiving space, and (B) a first-barrier-open position in which said first barrier is positioned to permit access to said first item-receiving space, said second barrier is adapted to move between: (A) a second-barrier-closed position in which said second barrier substantially restricts access to said second item-receiving space, and (B) a second-barrier-open position in which said second barrier is positioned to permit access to said second item-receiving space, said first barrier is substantially planar; and when said first barrier is in said first-barrier-closed position, said first barrier forms an angle of between about 60 and 90 degrees with a horizontal plane.

27. The dispenser of claim 26, wherein:

when said first barrier is in said first-barrier-open position, said first barrier forms an angle of between about 30 and −30 degrees with a horizontal plane.

28. The dispenser of claim 26, wherein:

said second barrier is substantially planar; and when said second barrier is in said second-barrier-closed position, said second barrier forms an angle of between about 60 and 90 degrees with a horizontal plane.

29. The dispenser of claim 28, wherein:

when said second barrier is in said second-barrier-open position, said second barrier forms an angle of between about 30 and −30 degrees with a horizontal plane.

30. A dispenser comprising:

a first barrier disposed within said dispenser;

a second barrier disposed within said dispenser, said second barrier being spaced apart from said first barrier, and wherein:

said first and second barriers at least partially define a first item-receiving space between said first and second barriers, said second barrier at least partially defines a second item-receiving space behind said second barrier, said first barrier is adapted to move between: (A) a first-barrier-closed position in which said first barrier substantially restricts access to said first item-receiving space, and (B) a first-barrier-open position in which said first barrier is positioned to permit access to said first item-receiving space, said second barrier is adapted to move between: (A) a second-barrier-closed position in which said second barrier substantially restricts access to said second item-receiving space, and (B) a second-barrier-open position in which said second barrier is positioned to permit access to said second item-receiving space, and when said first barrier is in said first-barrier closed position and said second barrier is in said second-barrier closed position:

said first barrier defines a bottom edge;

said second barrier defines a bottom edge;

said bottom edge of said first barrier is spaced apart from said bottom edge of said second barrier; and said bottom edge of said second barrier is vertically lower than said bottom edge of said second barrier.

31. The dispenser of claim 30, wherein, when said first barrier is in said first-barrier open position and said second barrier is in said second-barrier open position, said bottom edge of said second barrier is vertically lower than said bottom edge of said second barrier.

32. A dispenser comprising:

a first barrier disposed within said dispenser; and a second barrier disposed within said dispenser, said second barrier being spaced apart from said first barrier, and wherein:

said first and second barriers at least partially define a first item-receiving space between said first and second barriers, said second barrier at least partially defines a second item-receiving space behind said second barrier, said first barrier is adapted to move between: (A) a first-barrier-closed position in which said first barrier substantially restricts access to said first item-receiving space, and (B) a first-barrier-open position in which said first barrier is positioned to permit access to said first item-receiving space, said second barrier is adapted to move between: (A) a second-barrier-closed position in which said second barrier substantially restricts access to said second item-receiving space, and (B) a second-barrier-open position in which said second barrier is positioned to permit access to said second item-receiving space, and said dispenser further comprises:

a first barrier locking member for selectively locking said first barrier in said first-barrier-closed position; and a second barrier locking member for selectively locking said second barrier in said second-barrier-closed position.

33. A dispenser comprising:

a first barrier disposed within said dispenser;

a second barrier disposed within said dispenser, said second barrier being spaced apart from said first barrier, and wherein:

said first and second barriers at least partially define a first item-receiving space between said first and second barriers, said second barrier at least partially defines a second item-receiving space behind said second barrier, said first barrier is adapted to move between: (A) a first-barrier-closed position in which said first barrier substantially restricts access to said first item-receiving space, and (B) a first-barrier-open position in which said first barrier is positioned to permit access to said first item-receiving space, said second barrier is adapted to move between: (A) a second-barrier-closed position in which said second barrier substantially restricts access to said second item-receiving space, and (B) a second-barrier-open position in which said second barrier is positioned to permit access to said second item-receiving space, said dispenser comprises a first barrier locking member for selectively locking said first barrier in said first-barrier-closed position, said dispenser further comprises a second barrier locking member for selectively locking said second barrier in said second-barrier-closed position, and said second barrier locking member is positioned adjacent a free end of said second barrier to selectively restrict the movement of said second barrier into said second-barrier-open position.

34. A dispenser comprising:

a first barrier disposed within said dispenser;

a second barrier disposed within said dispenser, said second barrier being spaced apart from said first barrier, and wherein:

said first and second barriers at least partially define a first item-receiving space between said first and second barriers, said second barrier at least partially defines a second item-receiving space behind said second barrier, said first barrier is adapted to move between: (A) a first-barrier-closed position in which said first barrier substantially restricts access to said first item-receiving space, and (B) a first-barrier-open position in which said first barrier is positioned to permit access to said first item-receiving space, said second barrier is adapted to move between: (A) a second-barrier-closed position in which said second barrier substantially restricts access to said second item-receiving space, and (B) a second-barrier-open position in which said second barrier is positioned to permit access to said second item-receiving space, said dispenser comprises a first barrier locking member for selectively locking said first barrier in said first-barrier-closed position, and said first barrier locking member is adapted to rotate between a first-barrier-locked position in which said first barrier locking member restricts the movement of said first barrier into said first-barrier-open position, and a first-barrier-unlocked position in which said first barrier locking member does not substantially restrict the movement of said first barrier into said first-barrier-open position.

35. The dispenser of claim 34, wherein said first barrier locking member defines a recess for receiving a free end of said first barrier when said first barrier is in said first-barrier-closed position and said first barrier locking member is in said first-barrier-locked position.

36. The dispenser of claim 35, wherein said first barrier locking member is structured to physically restrict the movement of said free end of said first barrier out of said recess when said first barrier locking member is in said first-barrier-locked position and said first barrier is in said first-barrier-closed position.

37. The dispenser of claim 36, further comprising a locking member actuation device that is configured to selectively prevent said first barrier locking member from rotating from said first-barrier-locked position to said first-barrier-unlocked position.

38. The dispenser of claim 37, wherein:

said locking member actuation device comprises an elongate member comprising a first projecting portion; and said locking member actuation device is mounted adjacent said first barrier locking member so that said locking member actuation device may be moved between:

(A) a first position in which said first projecting portion engages a portion of said first barrier locking member to thereby prevent the movement of said first barrier locking member from said first-barrier-locked position to said first-barrier-unlocked position; and (B) a second position in which said locking member actuation device does not prevent the movement of said first barrier locking member from said first-barrier-locked position to said first-barrier-unlocked position.

39. The dispenser of claim 38, further comprising a biasing member for biasing said first barrier locking member towards said first-barrier-unlocked position, said biasing member being adapted to substantially automatically move said first barrier locking member from said first-barrier-locked position to said first-barrier-unlocked position in response to said locking member actuation device moving from said first position to said second position.

40. The dispenser of claim 38, wherein said locking member actuation device is pivotably mounted adjacent said first barrier locking member and configured to pivot between said first and second positions.

41. The dispenser of claim 38, further comprising an actuation device control member that is configured to selectively move said locking member actuation device from said first position into said second position.

42. The dispenser of claim 41, wherein:

said dispenser further comprises a second barrier locking member that is configured to be moved between a second-barrier-locked position in which said second barrier locking member maintains said second barrier in said second-barrier-closed position, and a second-barrier-unlocked position in which said second barrier locking member does not maintain said second barrier in said second-barrier-closed position; and said actuation device control member is configured to selectively move said locking member actuation device from said first position into said second position while also maintaining said second barrier locking member in said second-barrier-locked position.

43. The dispenser of claim 41, wherein:

said actuation device control member comprises a first extending portion; and said actuation device control member is mounted adjacent said locking member actuation device so that said actuation device control member may be moved between: (A) a first orientation in which said first extending portion engages a portion of said locking member actuation device to thereby move said locking member actuation device from said first position to said second position; and (B) a second orientation in which said actuation device control member does not move said locking member actuation device into said second position.

44. The dispenser of claim 43, further comprising:

a biasing member for biasing said locking member actuation device toward said first position, said biasing member being adapted to substantially automatically move said locking member actuation device from said second position to said first position in response to said actuation device control member moving from said first orientation to said second orientation; and a biasing member for biasing said first barrier locking member toward said first-barrier-unlocked position, said biasing member being adapted to substantially automatically move said first barrier locking member from said first-barrier-locked position to said first-barrier-unlocked position in response to said locking member actuation device moving from said first position to said second position.

45. The dispenser of claim 44, wherein said actuation device control member is mounted adjacent said locking member actuation device and configured to rotate between said first and second orientations.

46. The dispenser of claim 44, wherein:

said dispenser further comprises a second barrier locking member that is configured to be moved between a second-barrier-locked position in which said second barrier locking member maintains said second barrier in said second-barrier-closed position, and a second-barrier-unlocked position in which said second barrier locking member does not maintain said second barrier in said second-barrier-closed position; and said locking member actuation device is configured so that when said locking member actuation device is in said first position, said locking member actuation device engages a portion of said second barrier locking member to thereby prevent the movement of said second barrier locking member from said second-barrier-locked position to said second-barrier-unlocked position.

47. The dispenser of claim 46, wherein:

said locking member actuation device is configured to be moved into a third position when said first barrier locking member is in said first-barrier-unlocked position and said second barrier locking member is in said second-barrier-locked position; and said locking member actuation device is configured so that when said locking member actuation device is in said third position, said locking member actuation device does not prevent the movement of said second barrier locking member from said second-barrier-locked position to said second-barrier-unlocked position.

48. The dispenser of claim 47, wherein:

said locking member actuation device is configured so that when said locking member actuation device is in said third position, said locking member actuation device does not prevent the movement of said first barrier locking member from said first-barrier-unlocked position to said first barrier locked position.

49. The dispenser of claim 48, wherein:

said first barrier locking member is configured so that when said first barrier locking member moves from said first-barrier-unlocked position to said first-barrier-locked position, said first barrier locking member moves said locking member actuation device from said third position to said first position.

50. The dispenser of claim 49, wherein:

said locking member actuation device is a first locking member actuation device; and said dispenser further comprises a second locking member actuation device that is configured to selectively prevent said second barrier locking member from rotating from said second-barrier-locked position to said second-barrier-unlocked position.

51. The dispenser of claim 50, wherein:

said second locking member actuation device comprises an elongate member comprising a second projecting portion; and said second locking member actuation device is mounted adjacent said second barrier locking member so that said second locking member actuation device may be moved between: (A) a first configuration in which said second projecting portion engages a portion of said second barrier locking member to thereby prevent the movement of said second barrier locking member from said second-barrier-locked position to said second-barrier-unlocked position; and (B) a second configuration in which said second locking member actuation device does not prevent the movement of said second barrier locking member from said second-barrier-locked position to said second-barrier-unlocked position.

52. The dispenser of claim 51, further comprising a biasing member for biasing said second barrier locking member toward said second-barrier-unlocked position, said biasing member being adapted to substantially automatically move said second barrier locking member from said second-barrier-locked position to said second-barrier-unlocked position in response to said second locking member actuation device moving from said first configuration to said second configuration.

53. The dispenser of claim 52, wherein said second locking member actuation device is pivotably mounted adjacent said second barrier locking member and configured to pivot between said first and second configurations.

54. The dispenser of claim 52, wherein:

said actuation device control member is a first actuation device control member; and said dispenser further comprises a second actuation device control member that is configured to selectively move said second locking member actuation device from said first configuration into said second configuration.

55. The dispenser of claim 54, wherein:

said second actuation device control member comprises a second extending portion; and said second actuation device control member is mounted adjacent said second locking member actuation device so that said second actuation device control member may be moved between: (A) a first arrangement in which said second extending portion engages a portion of said second locking member actuation device to thereby move said second locking member actuation device from said first configuration into said second configuration; and (B) a second arrangement in which said second actuation device control member does not urge said second locking member actuation device into said second configuration.

56. The dispenser of claim 55, further comprising:

a biasing member for biasing said second locking member actuation device toward said first configuration, said biasing member being adapted to substantially automatically move said second locking member actuation device from said second configuration to said first configuration in response to said second actuation device control member moving from said first arrangement to said second arrangement; and a biasing member for biasing said second barrier locking member towards said second-barrier-unlocked position, said biasing member being adapted to substantially automatically move said second barrier locking member from said second-barrier-locked position to said second-barrier-unlocked position in response to said second locking member actuation device moving from said first configuration to said second configuration.

57. The dispenser of claim 56, wherein said second actuation device control member is mounted adjacent said second locking member actuation device and configured to rotate between said first and second arrangements.

58. The dispenser of claim 55, wherein:

said dispenser comprises a control shaft that is used to permit one or more items to be dispensed from said dispenser; and both said first actuation device control member and said second actuation device control member are mounted on said control shaft.

59. The dispenser of claim 58, wherein said dispenser further comprises a control shaft locking member for selectively restricting the rotation of said control shaft.

60. The dispenser of claim 59, wherein said control shaft locking member is configured for selectively restricting the rotation of said control shaft from a first angular position in which said first actuation device control member is in said first orientation, and a second angular position in which said first actuation device control member is in said second orientation.

61. The dispenser of claim 60, wherein said control shaft is adapted to be manually moved between said first and second angular positions by a user.

62. A dispenser comprising:

a first barrier disposed within said dispenser;

a second barrier disposed within said dispenser, said second barrier being spaced apart from said first barrier, and wherein:

said first and second barriers at least partially define a first item-receiving space between said first and second barriers, said second barrier at least partially defines a second item-receiving space behind said second barrier, said first barrier is adapted to move between: (A) a first-barrier-closed position in which said first barrier substantially restricts access to said first item-receiving space, and (B) a first-barrier-open position in which said first barrier is positioned to permit access to said first item-receiving space, said second barrier is adapted to move between: (A) a second-barrier-closed position in which said second barrier substantially restricts access to said second item-receiving space, and (B) a second-barrier-open position in which said second barrier is positioned to permit access to said second item-receiving space, and said dispenser further comprises a second barrier locking member for selectively locking said second barrier in said second-barrier-closed position.

63. The dispenser of claim 62, wherein said second barrier locking member is positioned adjacent a free end of said second barrier to selectively restrict the movement of said second barrier into said second-barrier-open position.

64. The dispenser of claim 63, wherein said second barrier locking member is adapted to rotate between a locked position in which said second barrier locking member restricts the movement of said second barrier into said second-barrier-open position, and an unlocked position in which said second barrier locking member does not substantially restrict the movement of said second barrier into said second-barrier-open position.

65. A dispenser comprising:

a first barrier disposed within said dispenser;

a second barrier disposed within said dispenser, said second barrier being spaced apart from said first barrier, and wherein:

said first and second barriers at least partially define a first item-receiving space between said first and second barriers, said second barrier at least partially defines a second item-receiving space behind said second barrier, said first barrier is adapted to move between: (A) a first-barrier-closed position in which said first barrier substantially restricts access to said first item-receiving space, and (B) a first-barrier-open position in which said first barrier is positioned to permit access to said first item-receiving space, said second barrier is adapted to move between: (A) a second-barrier-closed position in which said second barrier substantially restricts access to said second item-receiving space, and (B) a second-barrier-open position in which said second barrier is positioned to permit access to said second item-receiving space, said dispenser further comprises a third barrier that is positioned so that said third barrier is spaced apart from said second barrier, said second and third barriers at least partially define said second item-receiving space between said second and third barriers, said third barrier at least partially defines a third item-receiving space behind said third barrier, and said third barrier is adapted to move between: (A) a third-barrier-closed position in which said third barrier substantially restricts access to said third item-receiving space, and (B) a third-barrier-open position in which said third barrier is positioned to permit access to said third item-receiving space, said first barrier is mounted to pivot between said first-barrier-closed position and said first-barrier-open position, said first barrier is mounted to retract into a first recess after being pivoted into said first-barrier-open position, said second barrier is mounted to pivot between said second-barrier-closed position and a second-barrier-open position, and said second barrier is mounted to retract into a second recess after being pivoted into said second-barrier-open position.

66. The dispenser of claim 65, wherein said third barrier is mounted to pivot between said third-barrier-closed position and said third-barrier-open position; and said third barrier is mounted to retract into a third recess after being pivoted into said third-barrier-open position.

67. The dispenser of claim 66, wherein:

said first barrier is mounted to retract into said first recess until said third barrier is disposed substantially entirely within said third recess;

said second barrier is mounted to retract into said second recess until said second barrier is disposed substantially entirely within said second recess; and said third barrier is mounted to retract into said third recess until said third barrier is disposed substantially entirely within said third recess.

68. A dispenser comprising:

a first barrier disposed within said dispenser;

a second barrier disposed within said dispenser, said second barrier being spaced apart from said first barrier, and wherein:

said first and second barriers at least partially define a first item-receiving space between said first and second barriers, said second barrier at least partially defines a second item-receiving space behind said second barrier, said first barrier is adapted to move between: (A) a first-barrier-closed position in which said first barrier substantially restricts access to said first item-receiving space, and (B) a first-barrier-open position in which said first barrier is positioned to permit access to said first item-receiving space, said second barrier is adapted to move between: (A) a second-barrier-closed position in which said second barrier substantially restricts access to said second item-receiving space, and (B) a second-barrier-open position in which said second barrier is positioned to permit access to said second item-receiving space, said dispenser further comprises a third barrier that is positioned so that said third barrier is spaced apart from said second barrier, said second and third barriers at least partially define said second item-receiving space between said second and third barriers, said third barrier at least partially defines a third item-receiving space behind said third barrier, said third barrier is adapted to move between: (A) a third-barrier-closed position in which said third barrier substantially restricts access to said third item-receiving space, and (B) a third-barrier-open position in which said third barrier is positioned to permit access to said third item-receiving space, and when said first barrier is in said first-barrier closed position, said second barrier is in said second-barrier closed position, and said third barrier is in said third-barrier closed position:

said first barrier defines a bottom edge;

said second barrier defines a bottom edge;

said third barrier defines a bottom edge;

said bottom edge of said first barrier is spaced apart from said bottom edge of said second barrier;

said bottom edge of said first barrier is vertically lower than said bottom edge of said second barrier;

said bottom edge of said second barrier is spaced apart from said bottom edge of said third barrier; and said bottom edge of said second barrier is vertically lower than said bottom edge of said third barrier.

69. The dispenser of claim 68, wherein, when said first barrier is in said first-barrier closed position, said second barrier is in said second-barrier closed position, and said third barrier is in said third-barrier closed position:

said bottom edge of said first barrier is vertically lower than said bottom edge of said second barrier; and said bottom edge of said second barrier is vertically lower than said bottom edge of said third barrier.

70. A dispenser comprising:

an item housing; and a barrier disposed adjacent said item housing, said barrier being adapted to selectively restrict access to one or more items within said item housing, wherein:

said barrier is adapted to rotate between: (A) a closed position in which said barrier is in a substantially vertical orientation and restricts access to said one or more items within said item housing and (B) an open position in which said barrier does not substantially restrict access to said one or more items, said barrier is adapted to slide from said open position to a storage position, and said dispenser is configured for selectively dispensing items to one or more users.

71. The dispenser of claim 70, wherein:

said dispenser further comprises a storage chamber for storing said barrier; and said barrier is disposed at least partially within said storage chamber when said barrier is in said storage position.

72. The dispenser of claim 71, wherein:

said barrier is disposed substantially entirely within said storage chamber when said barrier is in said storage position.

73. The dispenser of claim 71, wherein:

said barrier is a first barrier;

said item housing is a first item housing;

said open position is a first-barrier open position;

said closed position is a first-barrier closed position;

said dispenser comprises a second barrier that at least partially defines said first item housing; and said second barrier is adapted to selectively restrict access to one or more items within a second item housing adjacent said second barrier.

74. The dispenser of claim 73, wherein:

said second barrier is adapted to rotate between: (A) a second-barrier closed position in which said second barrier restricts access to said one or more items within said second item housing; and (B) a second-barrier open position in which said second barrier does not substantially restrict access to said one or more items within said second item housing.

75. The dispenser of claim 74, wherein said second barrier is adapted to slide from said second-barrier closed position to a second-barrier storage position.

76. The dispenser of claim 75, wherein:

said storage chamber is a first storage chamber;

said dispenser further comprises a second storage chamber for storing said second barrier; and said second barrier is disposed at least partially within said second storage chamber when said second barrier is in said second-barrier storage position.

77. The dispenser of claim 76, wherein:

said second barrier is disposed at substantially entirely within said second storage chamber when said second barrier is in said second-barrier storage position.

78. The dispenser of claim 74, wherein:

said first barrier is in a substantially vertical orientation when said first barrier is in said first-barrier closed position; and said first barrier is in a substantially horizontal orientation when said first barrier is in said first-barrier open position.

79. The dispenser of claim 78, wherein:

said second barrier is in a substantially vertical orientation when said second barrier is in said second-barrier closed position; and said second barrier is in a substantially horizontal orientation when said second barrier is in said second-barrier open position.

80. The dispenser of claim 79, wherein said first and second barriers are substantially planar.

81. The dispenser of claim 80, wherein:

said first and second barriers are positioned in a step configuration.

82. A method of dispensing items comprising:

providing a horizontal array of barriers comprising a first barrier, a second barrier, and a third barrier;

positioning a first item between said first and second barriers;

positioning a second item between said second and third barriers;

dispensing said first item by rotating said first barrier from a first-barrier closed position in which said first barrier restricts access to said first item, to a first-barrier open position, in which said first barrier does not substantially restrict access to said first item; and dispensing said second item by rotating said second barrier from a second-barrier closed position in which said second barrier restricts access to said second item, to a second-barrier open position, in which said second barrier does not substantially restrict access to said second item, wherein:

said first barrier is substantially planar; and when said first barrier is in said first-barrier-closed position, said first barrier forms an angle of between about 60 and 90 degrees with a horizontal plane.

83. The method of dispensing item of claim 82, further comprising the step of, after dispensing said first item, sliding said first barrier from said first-barrier open position to a first-barrier storage position.

84. The method of dispensing item of claim 83, further comprising the step of, after dispensing said second item, sliding said second barrier from said second-barrier open position to a second-barrier storage position.

* * * * *